US006932294B1

(12) United States Patent
Larson

(10) Patent No.: US 6,932,294 B1
(45) Date of Patent: Aug. 23, 2005

(54) MULTIPURPOSE CABLE HANDLING TRAILER SYSTEM

(76) Inventor: Rick E. Larson, 579 Sioux St. South, Iroquois, SD (US) 57353

( * ) Notice: Subject to any disclaimer, the term of this patent is extended or adjusted under 35 U.S.C. 154(b) by 167 days.

(21) Appl. No.: 10/071,684

(22) Filed: Feb. 8, 2002

Related U.S. Application Data

(63) Continuation-in-part of application No. 09/627,715, filed on Jul. 28, 2000, now Pat. No. 6,347,761.

(51) Int. Cl.[7] ..... B65H 75/48

(52) U.S. Cl. ..... 242/390.5; 242/393; 242/397.3; 242/559.4

(58) Field of Search ..... 242/390.2, 390.5, 242/390.6, 397.1, 397.3, 393, 399.1, 39.2, 242/403, 559.4; 414/911; 254/323

(56) References Cited

U.S. PATENT DOCUMENTS

| | | | | |
|---|---|---|---|---|
| 2,679,987 | A | 6/1954 | Saliba | |
| D181,438 | S | 11/1957 | Peterson | |
| 2,867,390 | A | 1/1959 | Anrig | |
| D186,589 | S | 11/1959 | Peterson | |
| 3,091,413 | A | 5/1963 | Leithiser | |
| 3,941,324 | A * | 3/1976 | Green | |
| 4,091,946 | A * | 5/1978 | Kraeft et al. | 414/911 |
| 4,148,445 | A * | 4/1979 | Reynolds et al. | 242/397.1 |
| 4,174,809 | A | 11/1979 | Arlemark | |
| 4,583,700 | A | 4/1986 | Tschurbanoff | |
| 4,588,142 | A * | 5/1986 | Malzacher | |
| 4,701,098 | A | 10/1987 | Bills et al. | |
| 4,762,291 | A | 8/1988 | Sauber | |
| 4,767,073 | A | 8/1988 | Malzacher | |
| 4,796,826 | A * | 1/1989 | Pierce | 242/397.1 |
| 5,139,751 | A | 8/1992 | Mansfield et al. | |
| 5,215,272 | A | 6/1993 | Sauber | |
| 5,332,166 | A | 7/1994 | Kepes | |
| 5,402,959 | A | 4/1995 | Wadle | |
| 5,486,084 | A * | 1/1996 | Pitman et al. | |
| 5,520,258 | A * | 5/1996 | Kemshall | |
| 5,897,073 | A * | 4/1999 | McVaugh | |
| 6,092,756 | A * | 7/2000 | Sola | 242/397.1 |
| 6,148,688 | A * | 11/2000 | Nishimaki | |
| 2003/0127137 | A1 * | 7/2003 | Van Wie | |

* cited by examiner

*Primary Examiner*—William A. Rivera
(74) *Attorney, Agent, or Firm*—Leonard & Proehl, Prof. L.L.C.

(57) ABSTRACT

A multipurpose cable handling trailer system for dispensing and retrieving cable from a spool of cable. The system includes a trailer with a lifting assembly for lifting items into and off of the trailer. The system may include a cable guiding mechanism for guiding the cable onto and off of the spool. The system may include a dumpster assembly for permitting hauling of loose material on the trailer. The system may include a level winding assembly for guiding cable winding onto a spool when the spool is mounted on the lifting assembly. The system may include controls with a housing movably mounted on the trailer for permitting movement of the housing between a storage position and an operational position. The trailer may include a deck with a top extending between lateral sides of the trailer.

19 Claims, 20 Drawing Sheets

80
74
59
70
71
81
73
69
58
72
67
72
65
68

MULTIPURPOSE CABLE HANDLING TRAILER SYSTEM

REFERENCE TO RELATED APPLICATION

This application is a continuation-in-part of application Ser. No. 09/627,715, filed Jul. 28, 2000 now U.S. Pat. No. 6,347,761.

BACKGROUND OF THE INVENTION

1. Field of the Invention

The present invention relates to cable dispensing devices and more particularly pertains to a new multipurpose cable handling trailer system for dispensing and retrieving cable from a spool of cable.

2. Description of the Prior Art

The use of cable dispensing devices is known in the prior art. More specifically, cable dispensing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,402,959; U.S. Pat. No. 5,332,116; U.S. Pat. No. 4,583,700; U.S. Pat. No. 4,588,142; U.S. Pat. No. 4,701,098; U.S. Pat. No. 4,762,291; U.S. Pat. No. 5,215,272; U.S. Pat. No. 4,767,073; U.S. Des. Pat. No. 186,589; and U.S. Pat. No. Des. No. 181,438.

The multipurpose cable handling trailer system according to the present invention substantially departs from the conventional concepts and designs of the prior art, and in so doing provides an apparatus primarily developed for the purpose of dispensing and retrieving cable from a spool of cable.

SUMMARY OF THE INVENTION

In view of the foregoing disadvantages inherent in the known types of cable dispensing devices now present in the prior art, the present invention provides a new multipurpose cable handling trailer system construction wherein the same can be utilized for dispensing and retrieving cable from a spool of cable.

The general purpose of the present invention, which will be described subsequently in greater detail, is to provide a new multipurpose cable handling trailer system apparatus and method which has many of the advantages of the cable dispensing devices mentioned heretofore and many novel features that result in a new multipurpose cable handling trailer system which is not anticipated, rendered obvious, suggested, or even implied by any of the prior art cable dispensing devices, either alone or in any combination thereof.

To attain this, the present invention generally comprises a trailer with a lifting assembly for lifting items into and off of the trailer. The system may include a cable guiding mechanism for guiding the cable onto and off of the spool. The system may include a dumpster assembly for permitting hauling of loose material on the trailer. The system may include a level winding assembly for guiding cable winding onto a spool when the spool is mounted on the lifting assembly. The system may include controls with a housing movably mounted on the trailer for permitting movement of the housing between a storage position and an operational position. The trailer may include a deck with a top extending between lateral sides of the trailer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new multipurpose cable handling trailer system apparatus and method which has many of the advantages of the cable dispensing devices mentioned heretofore and many novel features that result in a new multipurpose cable handling trailer system which is not anticipated, rendered obvious, suggested, or even implied by any of the prior art cable dispensing devices, either alone or in any combination thereof.

It is another object of the present invention to provide a new multipurpose cable handling trailer system which may be easily and efficiently manufactured and marketed.

It is a further object of the present invention to provide a new multipurpose cable handling trailer system which is of a durable and reliable construction.

An even further object of the present invention is to provide a new multipurpose cable handling trailer system which is susceptible of a low cost of manufacture with regard to both materials and labor, and which accordingly is then susceptible of low prices of sale to the consuming public, thereby making such multipurpose cable handling trailer system economically available to the buying public.

Still yet another object of the present invention is to provide a new multipurpose cable handling trailer system which provides in the apparatuses and methods of the prior art some of the advantages thereof, while simultaneously overcoming some of the disadvantages normally associated therewith.

Still another object of the present invention is to provide a new multipurpose cable handling trailer system for dispensing and retrieving cable from a spool of cable.

Yet another object of the present invention is to provide a new multipurpose cable handling trailer system which includes a trailer with a lifting assembly for lifting items into and off of the trailer. The system may include a cable guiding mechanism for guiding the cable onto and off of the spool. The system may include a dumpster assembly for permitting hauling of loose material on the trailer. The system may include a level winding assembly for guiding cable winding onto a spool when the spool is mounted on the lifting assembly. The system may include controls with a housing movably mounted on the trailer for permitting movement of the housing between a storage position and an operational position. The trailer may include a deck with a top extending between lateral sides of the trailer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
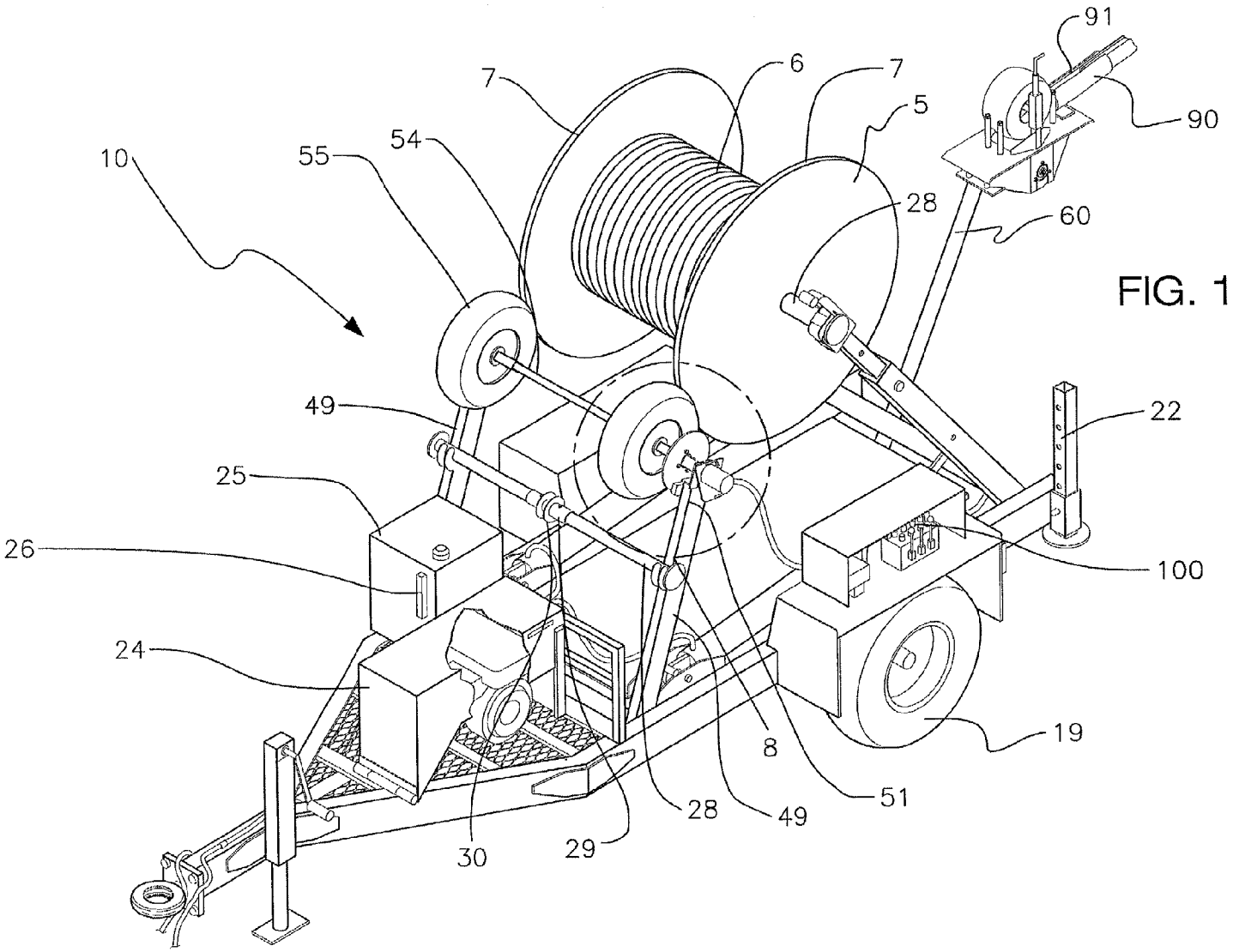
FIG. 1 is a schematic perspective view of a new multipurpose cable handling trailer system according to the present invention.
Figure 2:
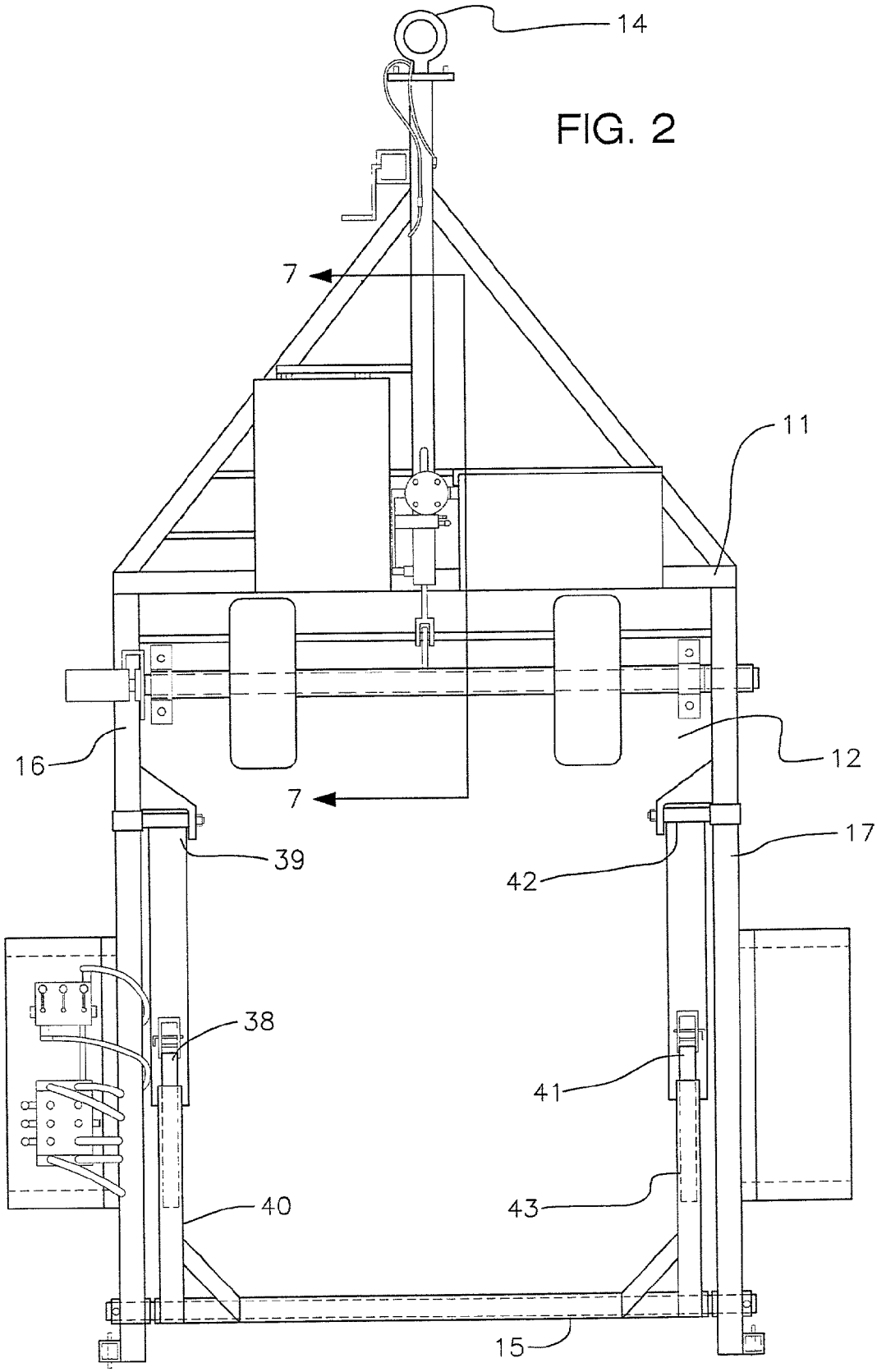
FIG. 2 is a schematic plan view of the present invention.

With reference now to the drawings, and in particular to FIGS. 1 through 20 thereof, a new multipurpose cable handling trailer system embodying the principles and concepts of the present invention and generally designated by the reference numeral 10 will be described.

As best illustrated in FIGS. 1 through 20, the multipurpose cable handling trailer system 10 generally comprises a trailer 11. The trailer 11 has a top surface 12, a bottom surface 13, a front end 14, a back end 15, a first lateral side 16 and a second lateral side 17. The front end 14 comprises a male hitch portion and the back end has a female hitch portion 18 coupled thereto. Each of a pair of wheels 19 is rotatably coupled to one of the lateral sides 16, 17, and preferably an axle extends between the wheels. Each of a pair of ramps 20 is movably positioned on guide rails 21 securely attached to the bottom surface 13 of the trailer 11. The guide rails 21 are orientated generally parallel with the lateral sides 17 and are positioned generally adjacent to the back end 15. The ramps 20 allow the trailer 11 to be used as a conventional hauling-type trailer when no spool 5 is being carried.

The trailer 11 may also include a deck 21 with a top on which items may be supported during transport movement of the trailer. Such items may include, for example, motorized equipment and materials. The top of the deck 21 may comprise a substantially continuous surface, and may extend from the first lateral side of the trailer to the second lateral side of the trailer for maximizing the size and amount of items that may be transported. The top of the deck may also be substantially planar. The deck may comprise a plurality of elongate boards, and the boards may comprise wood or even a composite material of sufficient strength and durability.

Each of a pair of stabilizing legs 22 is coupled to a free end of one of the lateral sides 16, 17 adjacent to the back end 15 of the trailer 11. Each of the stabilizing legs 22 is selectively extendable in a vertical direction.

A power supply 24 may be securely attached to the top surface 12 and positioned generally adjacent to the front end 14. The power supply 24 preferably comprises a motor and a hydraulic pump. The motor may comprise a fuel-fired engine or an electric motor, although a fuel-fired engine is preferred. The hydraulic pump is fluidly coupled to a tank 25 adapted for holding oil. The tank 25 is located generally adjacent to the power supply and is securely attached to the top surface 12. The tank 25 has a gauge 26 thereon incorporating a temperature gauge and a volume gauge. A separate tank 25 is desirable because the motor, or power supply 24, tends to overheat and a larger amount of oil helps to cool the motor while the miles of cable 6 are unwound from a spool 5. Optionally, a power supply may be located remotely from the trailer.

A lifting assembly may be included on the trailer for lifting items onto and off of the trailer (such as the deck), and for supporting one or more spools during transport of the spools and during cable winding and unwinding operations. The lifting assembly is pivotally mounted on the trailer. The lifting assembly may be mounted toward the back end of the trailer for extending the reach and retrieval capacity of the lifting assembly, and in one preferred embodiment is mounted at the back end of the trailer.

The lifting assembly may include an elongate pole 28. The elongate pole 28 of the lifting assembly is used for extending through the spool 5. The spool 5 has a middle portion and a pair of outer discs 7.

A pair of securing members 29 may be included, and each securing member may comprise a cylinder movably positionable on the elongate pole. Each of the cylinders has a wall 30 integrally coupled thereto and radially extending away therefrom for placement against the spool. Each of the securing members 29 is selectively securable to the elongate pole 28 by way of a fastening means, such as a bolt extending through the cylinder. The pole 28 is extended through the spool 5 and each of the securing members 29 is secured to the pole on an opposite side of the spool to keep the spool centered on the pole 28.

Figure 12:
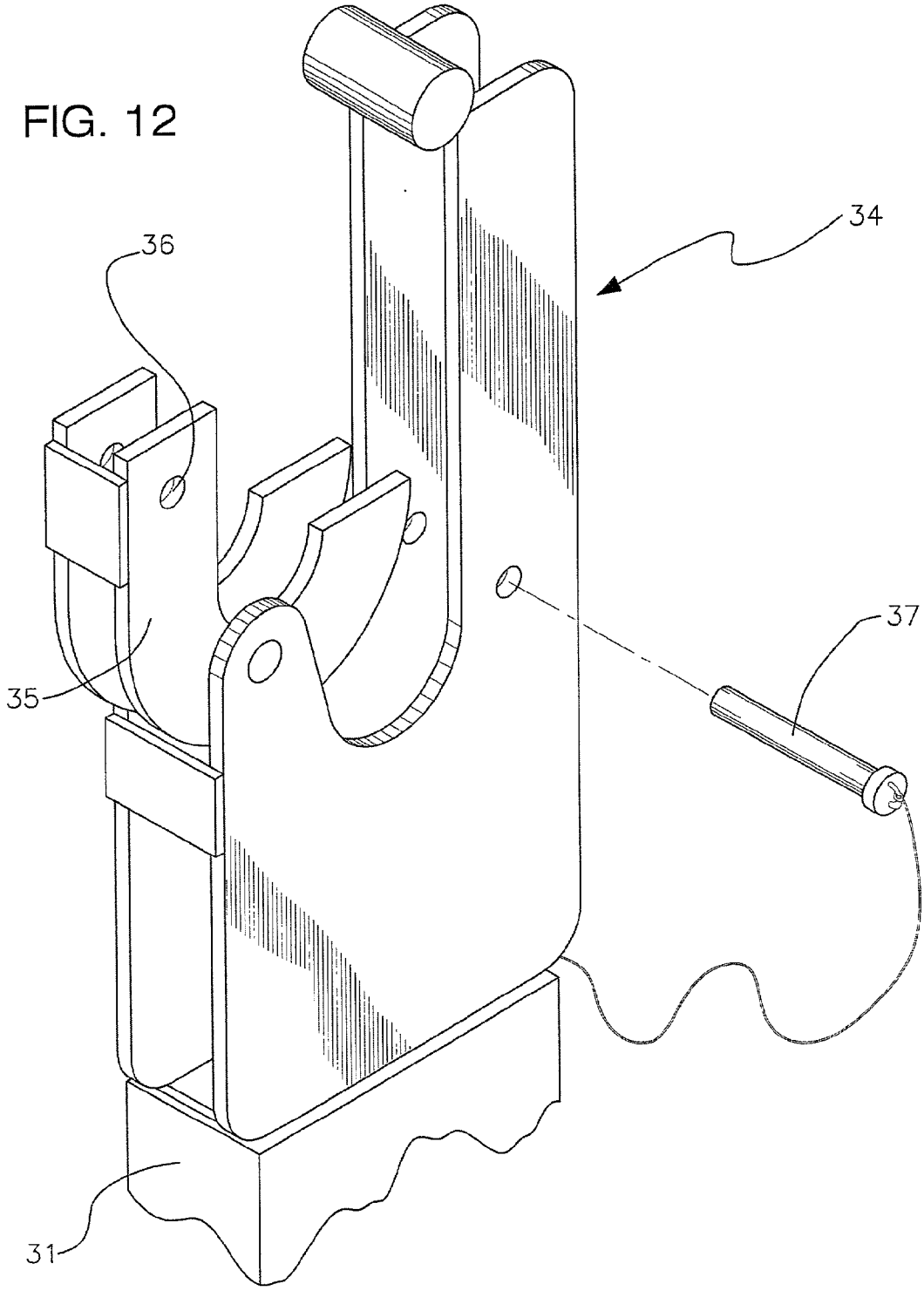
FIG. 12 is a schematic perspective view of the clamp of the present invention.
Figure 13:
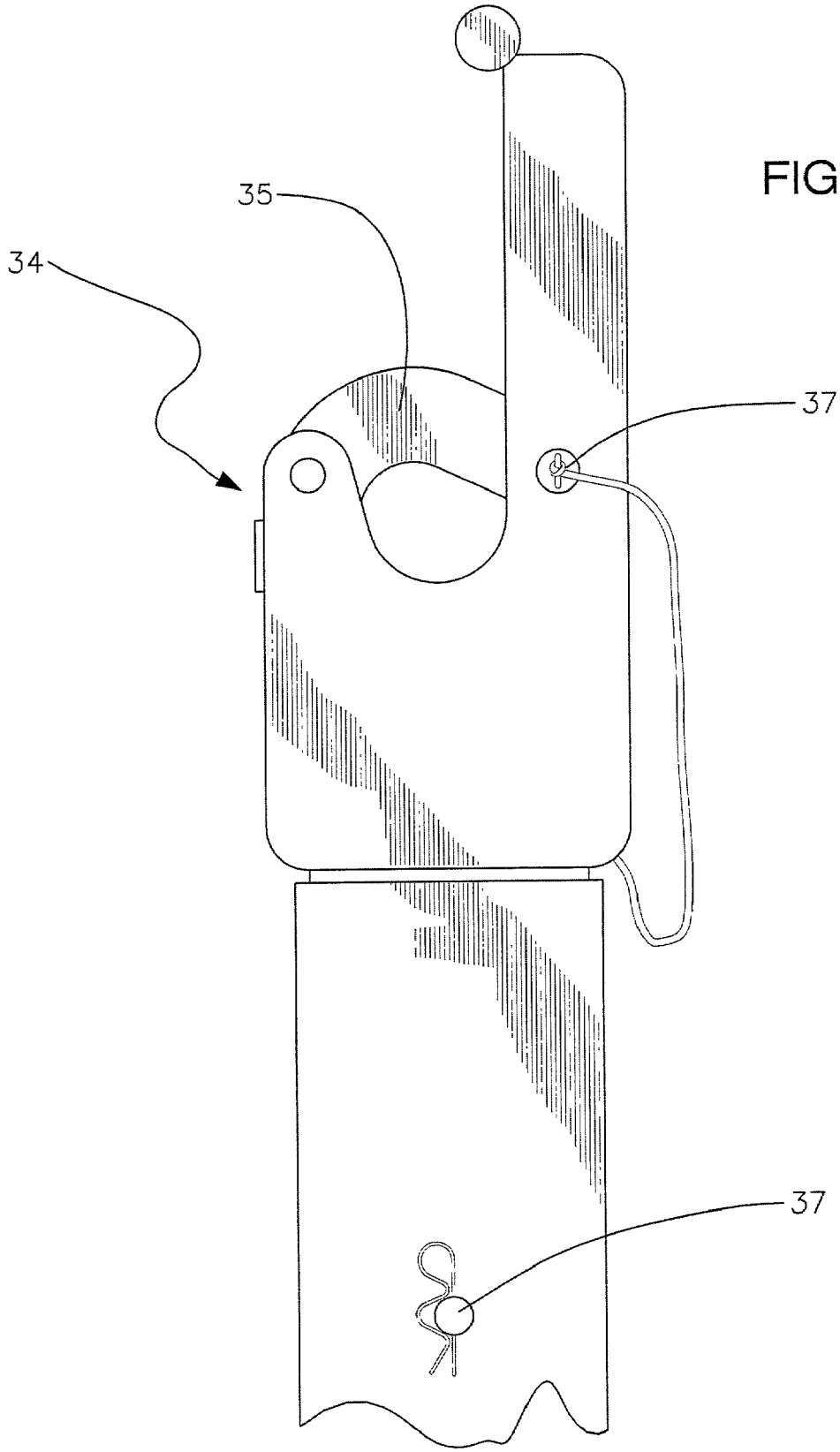
FIG. 13 is a schematic side view of the clamp of the present invention.
Figure 14:
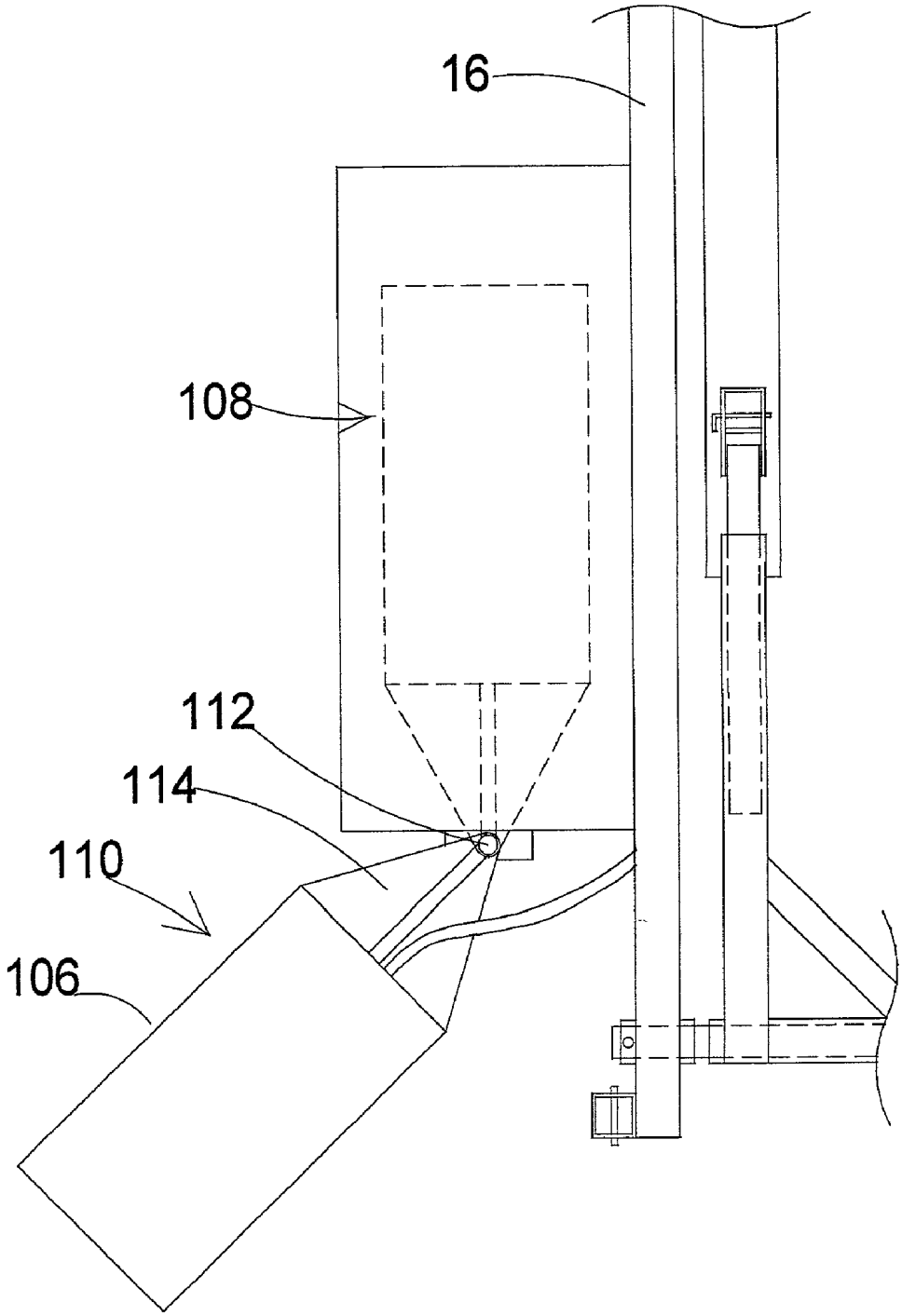
FIG. 14 is a schematic top view of a portion of the present invention showing an optional movable control housing in solid lines in an operational position and in broken lines in a storage position.
Figure 15:
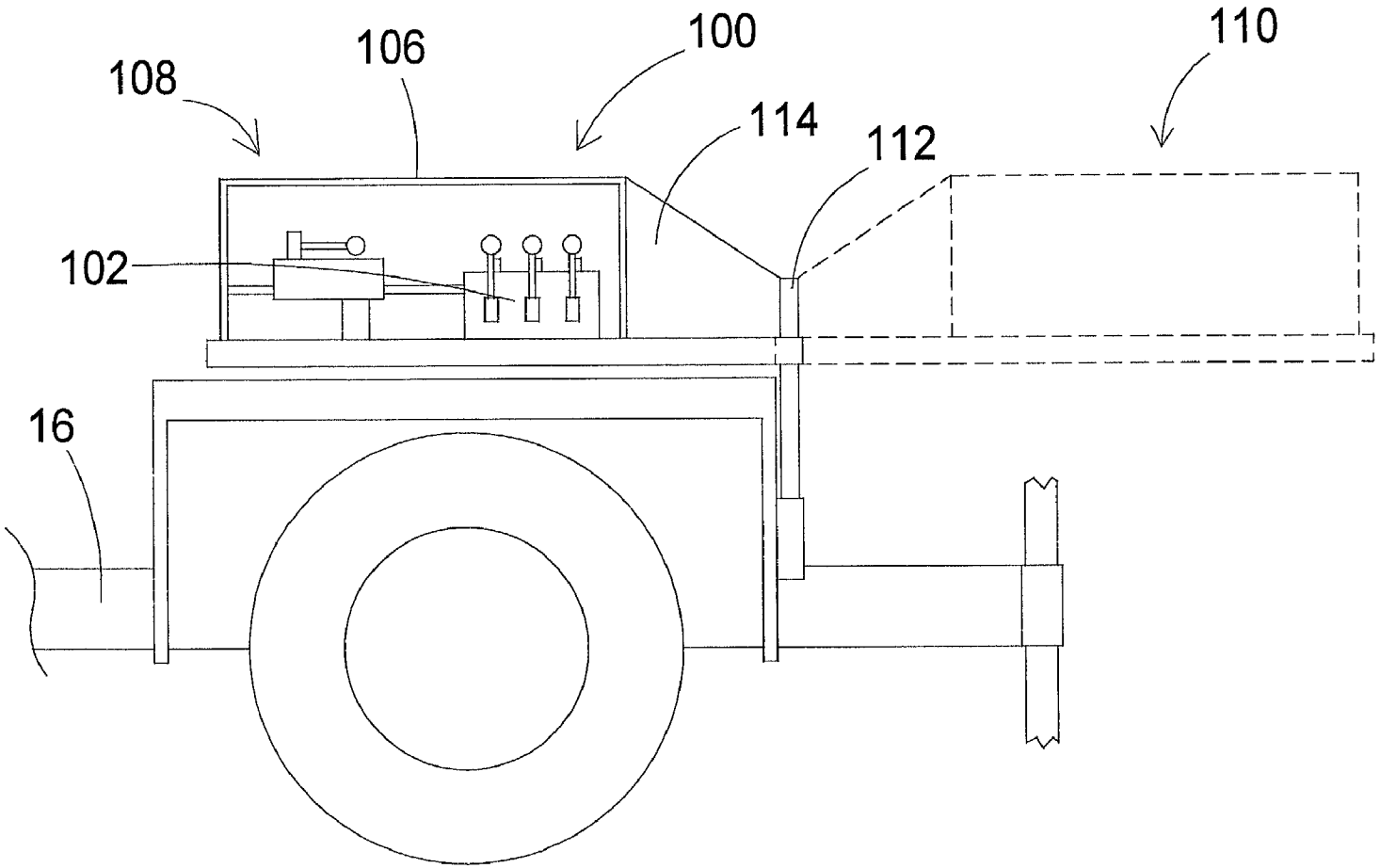
FIG. 15 is a schematic side view of a portion of the present invention showing the movable control housing in solid lines in the storage position and in broken lines in the operational position.
Figure 16:
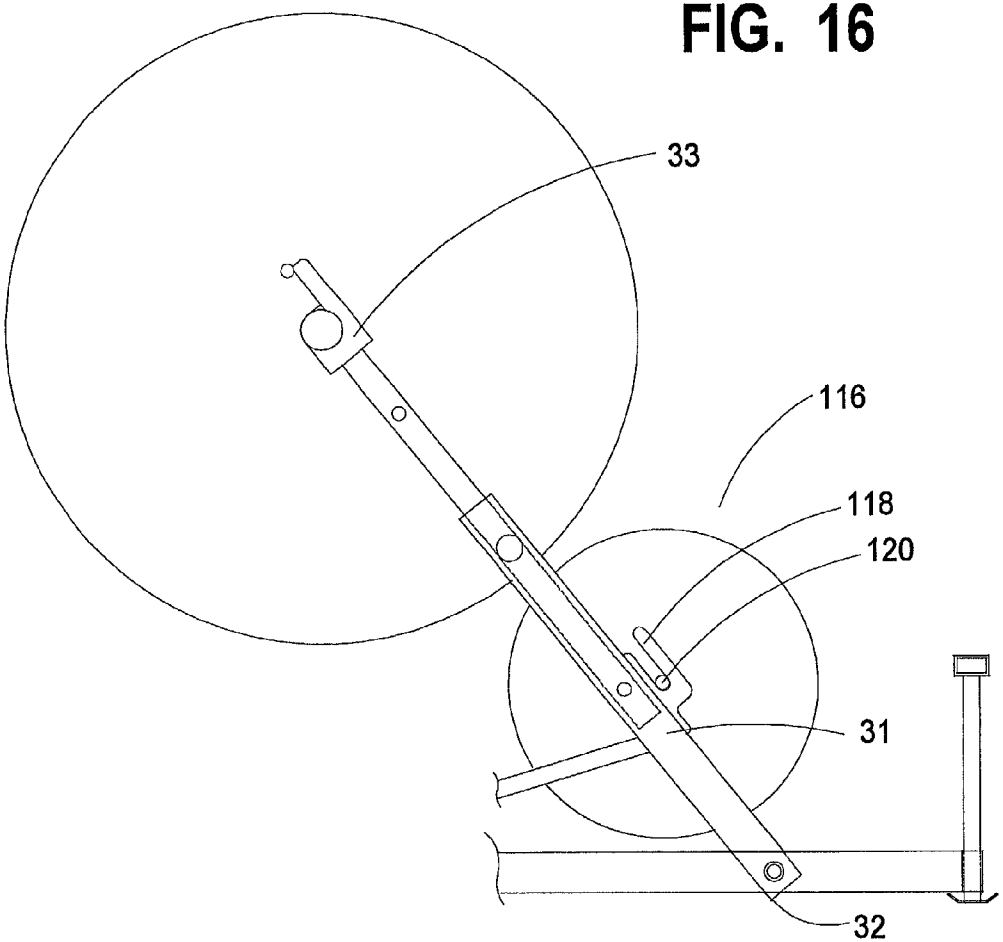
FIG. 16 is a schematic side view of a portion of the present invention showing a support arm with the auxiliary arbor support assembly.
Figure 17:
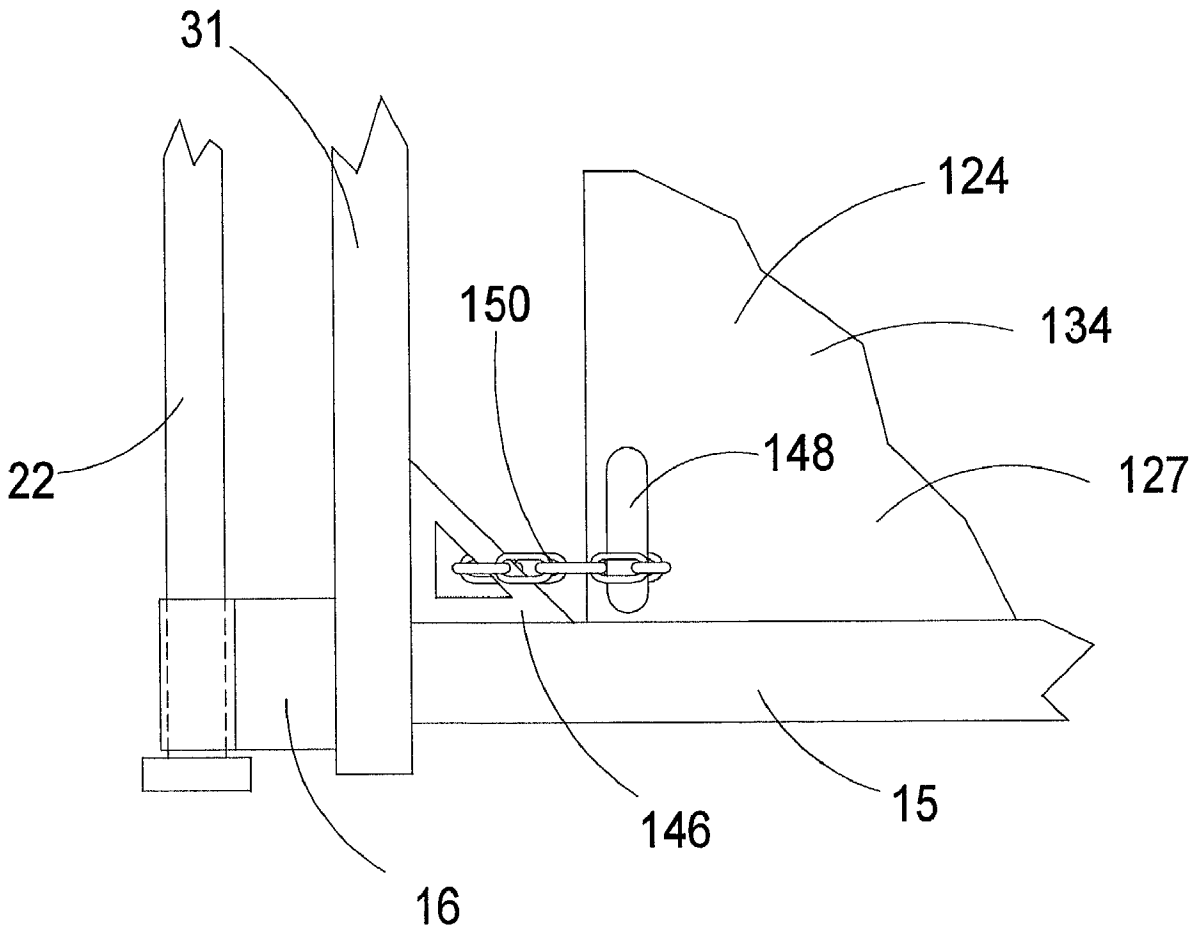
FIG. 17 is a schematic side view of a portion of the trailer of the present invention with an optional dumpster assembly shown mounted on the lifting assembly and rested on the deck of the trailer.
Figure 18:
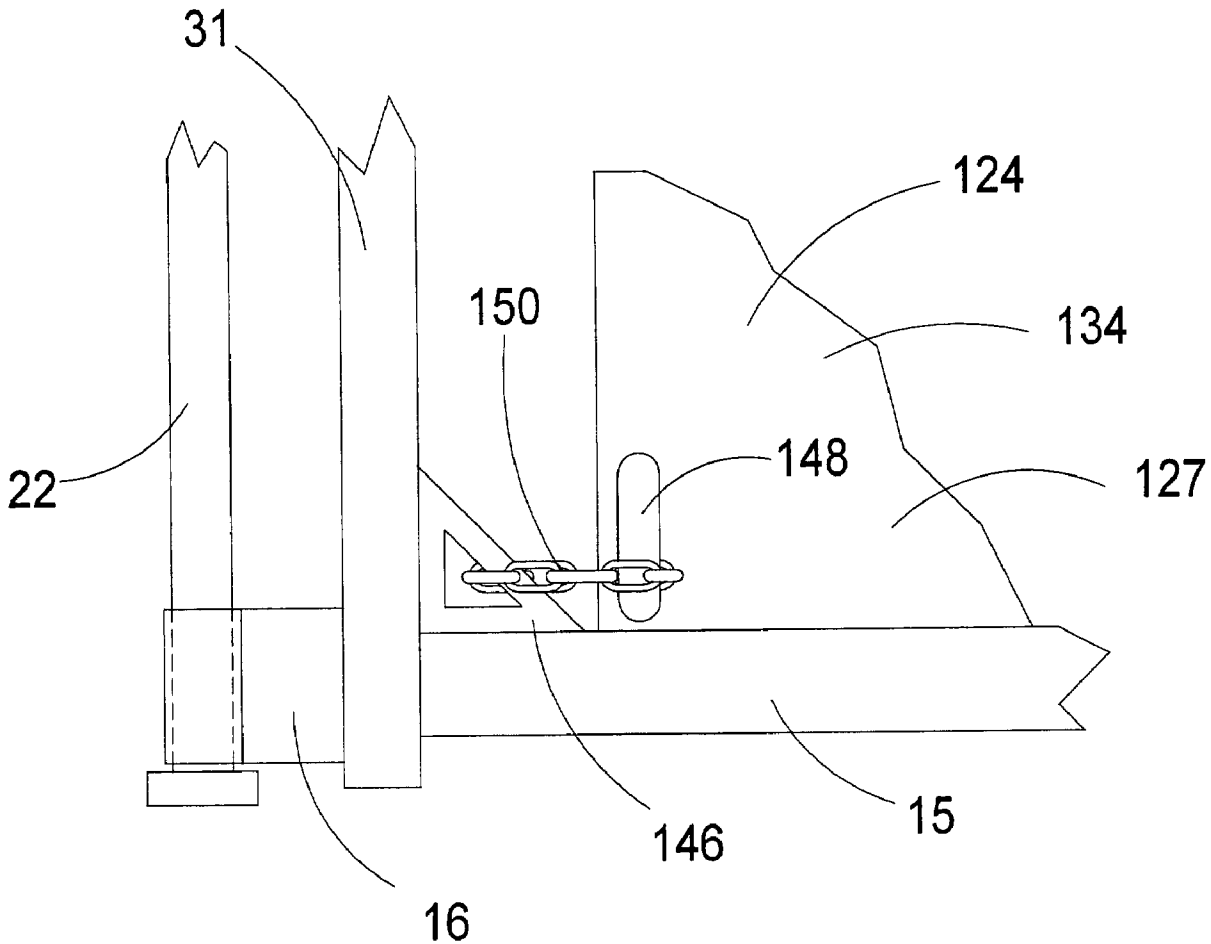
FIG. 18 is a schematic rear view of a broken away portion of the back end of the trailer, the first end of the support arm, and the dumpster receptacle, with the securing structure mounted thereon.
Figure 19:
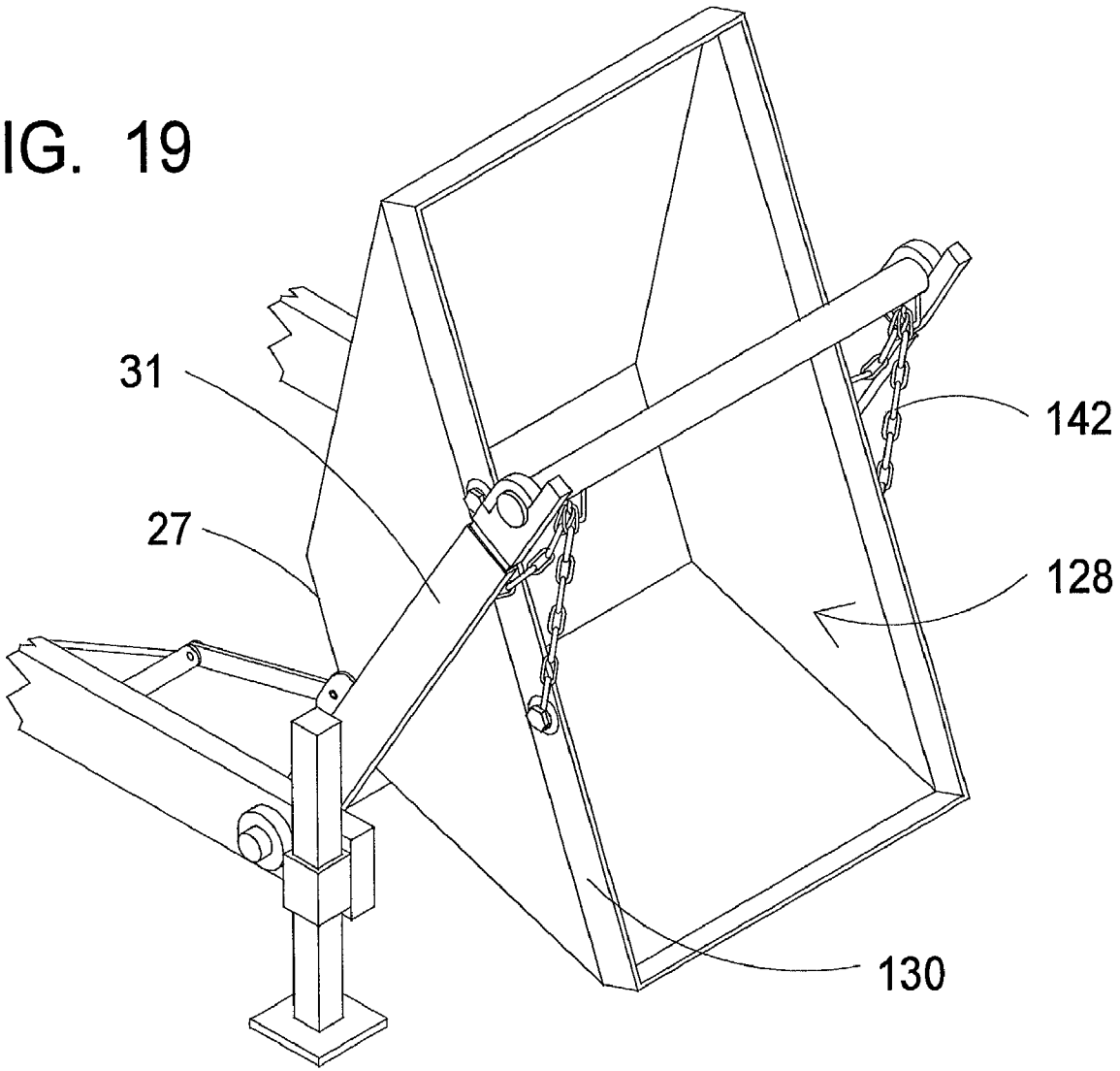
FIG. 19 is a schematic perspective view of the dumpster assembly in a dumping position.
Figure 20:
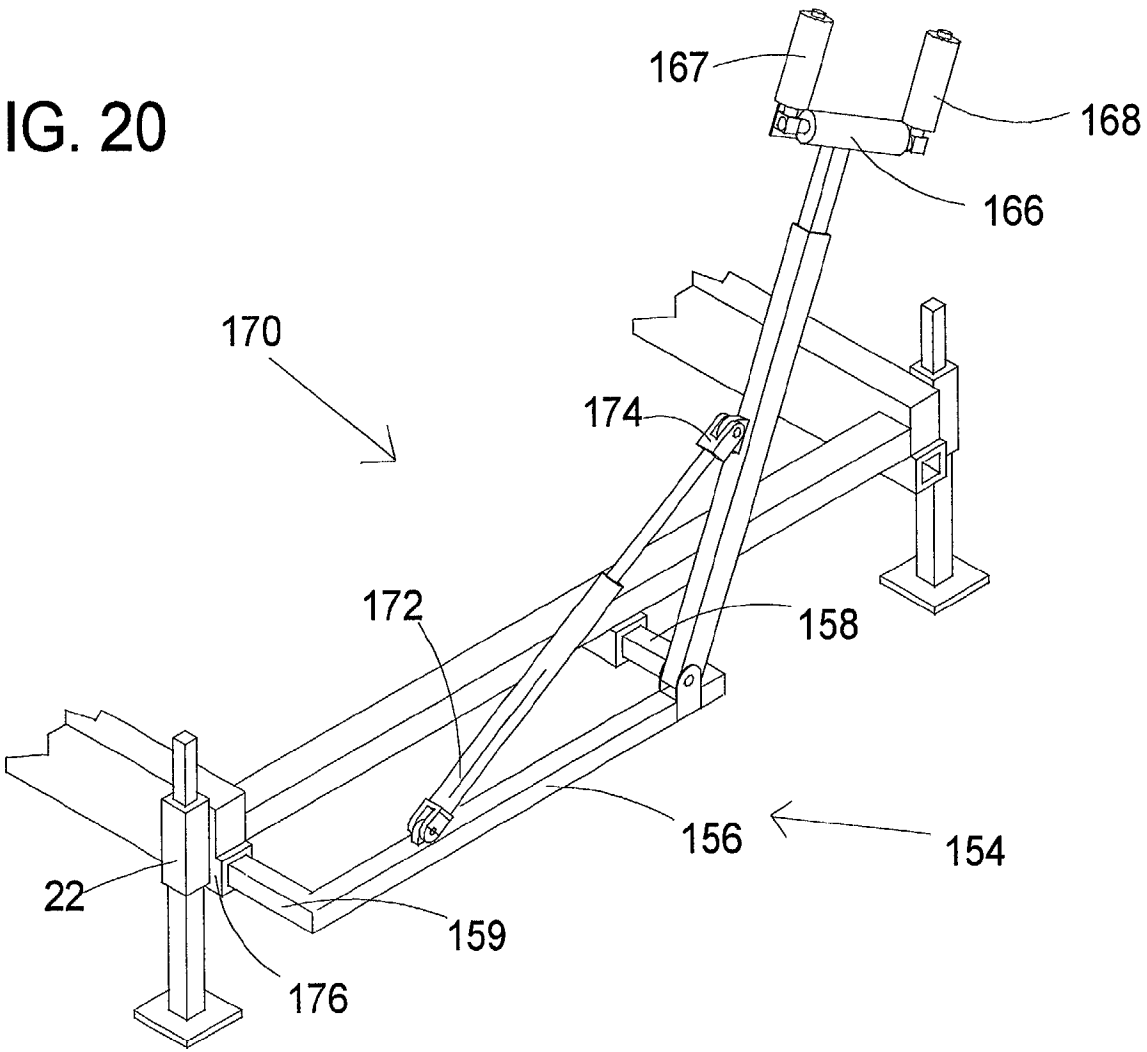
FIG. 20 is a schematic perspective view of an optional level winding assembly of the present invention.

The lifting assembly may include a pair of support arms 31. Each of the support arms is pivotally mounted on the trailer such that the support arms are pivotable between a transport position and a retrieve position. The transport position (see FIG. 1) may be characterized by the elongate pole being positioned above the deck of the trailer, and the retrieve position may be characterized by the elongate pole being positioned behind the back end of the trailer. The transport position may also be characterized by the elongate pole being positioned above the axle of the trailer. Each of the support arms 31 may be mounted on the trailer adjacent to one of the lateral sides 16, 17 of the trailer and adjacent to the back end 15 of the trailer. Each of the support arms 31 has a first end 32 and a second end 33. Each of the first ends 32 is rotatably coupled to one of the lateral sides 16, 17 and positioned generally adjacent to the back end 15. Each of the second ends 33 comprises a clamp 34. Each of the clamps 34 is adapted to removably couple to the pole such that the pole 28 is rotatably coupled to each of the support arms 31. As depicted in FIGS. 12 and 13, a jaw 35 is used to swing over the pole 28. The jaw 35 has a pair of bores 36 for receiving a pin 37 to selectively secure the jaw 35 in a closed position. The jaw-type design helps prevent the unwanted removal of the pole 28 if the pin 37 is not in place. Each of the support arms 31 is telescoping arms such that a length between the first and second ends of each of the arms may be selectively varied. A pin is used to secure the arms in at a desired length.

An actuating assembly may be included for pivotally moving the pair of support arms between the transport and retrieve positions. The actuating assembly may comprise a pair of actuators.

A first actuator 38 comprises an elongate actuator having a first end 39 and a second end 40. The first actuator 38 is adapted to selectively vary the length between the first 39 and second 40 ends of the first actuator 38. The first end 39 of the first actuator 38 is pivotally coupled to the first lateral side 16 and positioned generally between the front 14 and back 15 ends. The second end 40 of the first actuator 38 is pivotally coupled to a first of the support arms 31 pivotally coupled to the first lateral side 16. The first actuator 38 is mechanically or hydraulically coupled to the power supply 24. The first actuator 38 preferably comprises a hydraulic actuator.

A second actuator 41 comprises an elongate actuator having a first end 42 and a second end 43. The second actuator 41 is adapted to selectively vary the length between the first 42 and second 43 ends of the second actuator 41. The first end 42 of the second actuator is pivotally coupled to the second lateral side 17 and positioned generally between the front and back ends. The second end 43 of the second actuator is pivotally to a second of the support arms 31 pivotally coupled to the second lateral side 17. The second actuator 41 is mechanically or hydraulically coupled to the power supply 24. The second actuator 41 preferably comprises a hydraulic actuator. Ideally, the actuators 38, 41 comprise a hydraulic piston and rod.

A driving means may be provided for controlling the rotation of the spool 5. The driving means may comprise a spool engaging structure for engaging at least one of the outer discs of the spool, and a support structure for supporting the spool engaging structure.

The support structure may include a first, or pivotal, axle 44. The first axle 44 extends between and is rotatably coupled to the lateral sides 16, 17. The first axle 44 is positioned generally between the front end 14 and the support arms 31. An actuating member 45 comprises an elongate actuator having a first end 46 and a second end 47. The actuating member 45 is adapted to selectively vary the length between the first 46 and second 47 ends of the actuating member 45. The first end 46 of the actuating member 45 is pivotally coupled to the top surface 12 of the trailer 11. The second end 47 of the actuating member is pivotally coupled to an upright member 48 integrally coupled to the first axle 44. The actuating member 45 is mechanically coupled to the power supply 24.

Each of a pair of the bars 49 is elongate and has a first end 50 and a second end 51. The first ends 50 are integrally coupled to the first axle 44 and extend away from the axle 44 in a parallel direction. Each of the bars 49 is located generally adjacent to one of the lateral sides 16, 17. A protruding member 52 is integrally coupled to a first of the bars 49 and is positioned generally adjacent to the second end 51 of the first arm. The protruding member 52 has a hole 53 extending therein.

The spool engaging structure may include a second, or rotator, axle 54 that extends between and is rotatably coupled to the second ends 51 of the bars 49. A pair of wheels 55 is each removably mounted on the second axle 54 and is positioned between the bars 49. The wheels 55 are adapted to be positioned anywhere along the length of the second axle 54 to accommodate varying sized spools 5. Each of the wheels has a circumferential surface for engaging a circumferential edge of one of the outer discs of the spool.

A disc portion 56 is securely mounted on the second axle 54 such that the second axle 54 extends through an axis of the disc portion 56. The disc portion 56 is located generally adjacent to the first bar. A braking means 57 frictionally engages the disc portion and is securely coupled to the first of the bar 49. The braking means 57 is mechanically coupled to the power supply 24 and preferably comprises a hydraulic brake.

A motor 58 is securely coupled to a plate 59. The plate 59 has a rod 52 extending therefrom. The rod 80 is removably extendable in the protruding member 52. The plate 59 has a hole 81 therethrough for removably receiving an end of the second axle 54. The motor 58 is adapted to rotate the second axle 54. The motor 58 is mechanically or hydraulically coupled to the power supply 24. The motor 58 preferably comprises a hydraulic motor adapted for selectively rotating the second axle forward or backward, though an electric motor may be used as well.

A cable guiding means guides the cable 6 on and off of the spool 5. The cable guiding means may include a guide structure for engaging a portion of cable moving onto and off of the spool, and a boom structure mounted on the trailer for supporting the guide structure on the trailer. The boom structure may be pivotally mounted on the trailer such that the guide structure is movable along a path extending generally transverse to an axis of the trailer extending between the front and back ends of the trailer. The boom structure may have a proximal end pivotally mounted on the trailer and a distal end extending away from the back end of the trailer in a cantilevered manner.

The boom structure of the cable guiding means may include an elongate member 60. The elongate member 60 has a first end 61 and a second end 62. The elongate member 60 has a bend 63 therein located generally adjacent to the first end 61. The bend 63 ideally defines an angle generally between 135 degrees and 170 degrees.

The boom structure may also include a mounting member 64 receives the first end 61 of the elongate member 60. The mounting member 64 is coupled to and extends upwardly from the back end 15 of the trailer 11. The mounting member 60 has a well extending therein. The first end 61 of the elongate member 60 is extendable into the well such that the elongate member 60 is rotatable with respect to the trailer portion 11.

The guide structure may include first and second rotatable members 74, 78 which each have circumferential surfaces positionable adjacent to each other for moving a portion of the cable positioned between the circumferential surfaces of the first and second rotatable members. The first and second rotatable member may be movable toward and away from each other such that the circumferential surface of the second rotatable member is abuttable against the circumferential surface of the first rotatable member. The second rotatable member 78 may be positioned above the first rotatable member 74. The first and second rotatable members may each comprise a tire.

The guide structure may include a panel 65, which is substantially rigid, has a top side 66, a bottom side 67, a distal portion 68, a middle portion 69 and a proximal portion 70. The second end 62 of the elongate member 60 is removably coupled to the bottom side 67 of the distal portion 68 of the panel 65. The panel 65 has a slot 71 therethrough positioned in a middle portion 69 of the panel.

The guide structure may also include a pair of walls 72 that extend downwardly from and is integrally coupled to the bottom side 67 of the panel 65. Each of the walls 72 is positioned on an opposite side of the slot 71. An arm 73 extends between and is rotatably coupled to the walls 72. The arm 73 extends through and is securely attached to a first tire portion 74 such that a perimeter of the first tire portion extends upwardly through the slot 71. One of the walls 72 has a hole 75 therethrough for receiving the rod 80 coupled to the plate 59 such that the motor 58 may engage the arm 73.

The guide structure may further include a vertically extending implement 76 that is integrally coupled and extends upwardly from the top side 66 of the panel 65. A bracket 77 is movably positioned on the vertically extending implement 76. A second tire portion 78 is rotatably coupled to the bracket 77 such that the second tire 78 may be selectively positioned nearer or further away from the panel 65. The bracket 77 is selectively securable in a vertical direction to place a desired distance between the first 74 and second 78 tire portions.

The guide structure may additionally include a pair of guide members 79 that guide the cable 6 between the first 74 and second 78 tire portions. Each of the guide members 79 is positioned on opposite sides of the second tire portion 78. Each of the guide members 79 comprises a pair of upstanding members.

The guide structure may include a cylinder 90 that is securely attached to the top side 66 of the proximal portion 70 and extends away therefrom. The cylinder 90 has a pair of ends. The cylinder 90 has a peripheral wall having a slit 91 therein. The slit 91 extends between the ends of the cylinder.

The guide structure may further include an extension member 94 that comprises an outer sleeve 95 and an inner sleeve 96. The inner sleeve 95 is positioned in the outer sleeve 96. Each of the sleeves are substantially rigid. Each of the sleeves has a generally cylindrical shape. The inner sleeve 95 is rotatable with respect to the outer sleeve 95. Each of the sleeves has an elongate slit 97 extending between their respective ends. The extension member 94 is positionable in the cylinder 90.

A control means 100 controls the power supply 24. The control means 100 is operationally coupled to the power supply 24, the first 38 and second 41 actuators, the actuating member 45, the breaking means 57 and the motor 58. The control means is attached to the trailer. The control means 100 comprises conventional controls.

In one embodiment of the invention, the control means comprises a plurality of control valves 102 for controlling flow of hydraulic fluid between the power supply and the first and second actuators of the lifting assembly, the motor of the cable guiding means, and the motor, braking means, and actuating member of the driving means to the extent that these features are included in an embodiment of the invention.

The control means 100 may also include a housing on which at least a portion of the plurality of control valves are mounted, or operator controls for remotely actuating control valves mounted elsewhere in the trailer. In one embodiment of the invention, a housing of the control means is substantially immovably mounted on one of the lateral sides 17, 18 of the trailer, and may be mounted on a fender of the trailer (see, for example, FIGS. 1 and 3).

In another embodiment of the invention, a housing 106 is movably mounted on the trailer, and is movable between a storage position 108 and an operational position 110. The operational position 100 may be characterized by the housing extending rearwardly of the back end of the trailer, and the storage position 108 may be characterized by the housing being positioned above the trailer, such as, for example, above one of the fenders of the trailer. A pivot mount 112 may pivotally connect the housing 106 to the trailer 11, and may have a pivot axis about which the housing pivots. The pivot mount 112 may pivot the housing in a substantially horizontal plane. The pivot mount 112 may be mounted on a lateral side of the trailer, and may be located on the trailer between the back end of the trailer and the axle assembly of the trailer. A pivot arm 114 may extend between the pivot mount 112 and the housing 106 for spacing the housing from the pivot axis of the pivot mount.

Significantly, the pivotability of the housing permits the control valves to be positioned adjacent to an operator standing next to and swinging the cable guiding means of the invention when that is installed. In use, the cable guiding means is positioned at the back end of the trailer and the housing may then be pivoted to a position that is rearward of the trailer, so that the operator may swing the boom structure with one hand and adjust the control valves as necessary with the other hand. Advantageously, this structure can eliminate the need for one operator to operate the controls and an additional operator to manipulate the cable guiding means.

Optionally, the invention may further include an auxiliary arbor support assembly 116 (see FIG. 16) for supporting an additional pole and spool on the pair of support arms 31 at a location spaced from the pole 28 that is removably mounted on the second ends 33 of the pair of support arms. The auxiliary arbor support assembly may comprise a supplemental hook member 118 mounted on each of the support arms at a location spaced from the first 32 and second 33 ends of the support arms. The auxiliary arbor support assembly may also include an additional post 120 removably mounted on the supplemental hook members 118 for supporting a spool.

The invention may also include a dumpster assembly 122 for permitting the hauling, for example, of loose material on the trailer. The dumpster assembly may be removably restable on the deck 21 of the trailer. The dumpster assembly may comprise a dumpster receptacle 124 having a top 126 and a bottom 127, and may have an upper opening 128 at the top that opens into an interior cavity of the dumpster receptacle. The dumpster receptacle 124 may also have an upper rim portion 130, a bottom wall portion 132, and a perimeter wall portion 134 extending between the upper rim portion and the bottom wall portion.

The dumpster assembly 122 may further include a linking structure for removably linking the dumpster receptacle 124 to the elongate pole 28 of the lifting assembly. The linking structure may include a pair of linking assemblies 136 with the lateral separation between the pair of linking assemblies being adjustable. Each of the linking assemblies may comprise at least one loop mount 138 mounted on the dumpster receptacle adjacent to the top of the dumpster receptacle. A pair of the loop mounts may be mounted on the upper rim portion 130 of the dumpster receptacle at spaced locations thereon. The linking assemblies may also include a linking collar 140 that is removably mounted on the elongate pole 28, and may include a linking element 142 removably connecting the dumpster receptacle 124 to the linking collar 140. The linking element 142 connects the loop mount or mounts on the dumpster receptacle to the linking collar on the elongate pole. The linking element may be flexible, and may comprise a length of chain having opposite ends mounted on the loop mount or mounts and an intermediate portion of the chain may be removably hooked on the linking collar.

The dumpster assembly may also include a securing assembly for removably securing the dumpster receptacle to the support arms 31. The securing assembly may include a pair of securing structures 144 located at laterally spaced locations on the trailer. Each of the securing structures may include an arm loop 146 mounted on one of the support arms 31. The arm loop 146 may be located toward the first end 32 of the support arm 31 for minimizing movement of the arm loop as the support arm is moved between the transport and retrieve positions of the support arms. Each of the securing structures may also include a dumpster loop 148 mounted on the dumpster receptacle 124. The dumpster loop 148 may be located toward the bottom of the dumpster receptacle. Each of the securing structures may also include a securing element 150 removably linking the dumpster receptacle 124 to the support arm 31. The securing element 150 may connect the arm loop 146 on the support arm 31 to the dumpster loop on the dumpster receptacle. The securing element 150 may be flexible, and may comprise a length of chain.

In operation, the linking assemblies 136 act to lift at least a portion of the dumpster receptacle 124 off of the deck 21 of the trailer 11 as the lifting assembly moves from the transport position toward the retrieve position of the lifting assembly. The securing structure 144 resists swinging of a portion of the bottom 127 of the dumpster receptacle 124 and in effect trips the receptacle so that the receptacle rotates upward and rearward with respect to the trailer. The contents of the dumpster receptacle 124 is thus dumped from the interior of the receptacle to a location generally behind the trailer.

Optionally, the linking assemblies 136—or a portion thereof—may be linked to other items of cargo for loading and unloading the items onto and off of the deck 21 of the trailer 11 by moving the lifting assemblies between the transport and retrieve positions.

As a further option, the invention may include a level winding assembly 152 for guiding cable winding onto a spool when the spool is mounted on the lifting assembly. The level winding assembly 152 may be laterally movable with respect to the trailer for guiding the cable laterally with respect to the spool to achieve a uniform winding on the spool. The level winding assembly 152 may include a base structure 154 for removably mounting on the trailer. The base structure 154 may include a base member 156 and a pair of mounting members 158, 159 mounted on the base structure and being removably mountable on the trailer. A first one 158 of the mounting members may be removably mountable in the female hitch portion 18 and a second one 159 of the mounting members may be laterally spaced from the first mounting member 158 when the first mounting member is mounted on the female hitch portion.

The level winding assembly 152 may also include a swing structure 160 that is pivotally mounted on the base structure 154 for engaging a portion of the cable. The swing structure 160 may include an arm 162 that has a lower end pivotally mounted on the base structure 154 and an upper end. Optionally, the arm 162 may have an upper portion and a lower portion telescopically mounted together such that the distance between the upper and lower ends of the arm may be adjusted. The swing structure may also include a head portion 164 mounted on an upper end of the arm. The head portion may include a plurality of rollers 166, 167, 168 formed into a U-shaped configuration with an open top for receiving the cable therethrough.

The level winding assembly 152 may also include a swing actuator structure 170 for pivoting the swing structure 160 with respect to the base structure 154. The swing actuator structure 170 may have a first end 172 mounted on the base structure 154 and a second end 174 mounted on the swing structure 160, and a length of the swing actuator structure between the first and second ends may be adjustable to thereby swing the swing structure with respect to the base structure. The swinging movement of the swing structure permits the operator to vary the location that a portion of a cable being wound onto the spool actually winds onto the spool.

For the purpose of mounting the second mounting member 159 to the trailer, a lateral receiver tube 176 may be mounted on the trailer for having the second mounting member removably inserted therein. The lateral receiver tube 176 may be located on the back end 15 of the trailer at a location laterally spaced from the female hitch portion 18.

Figure 3:
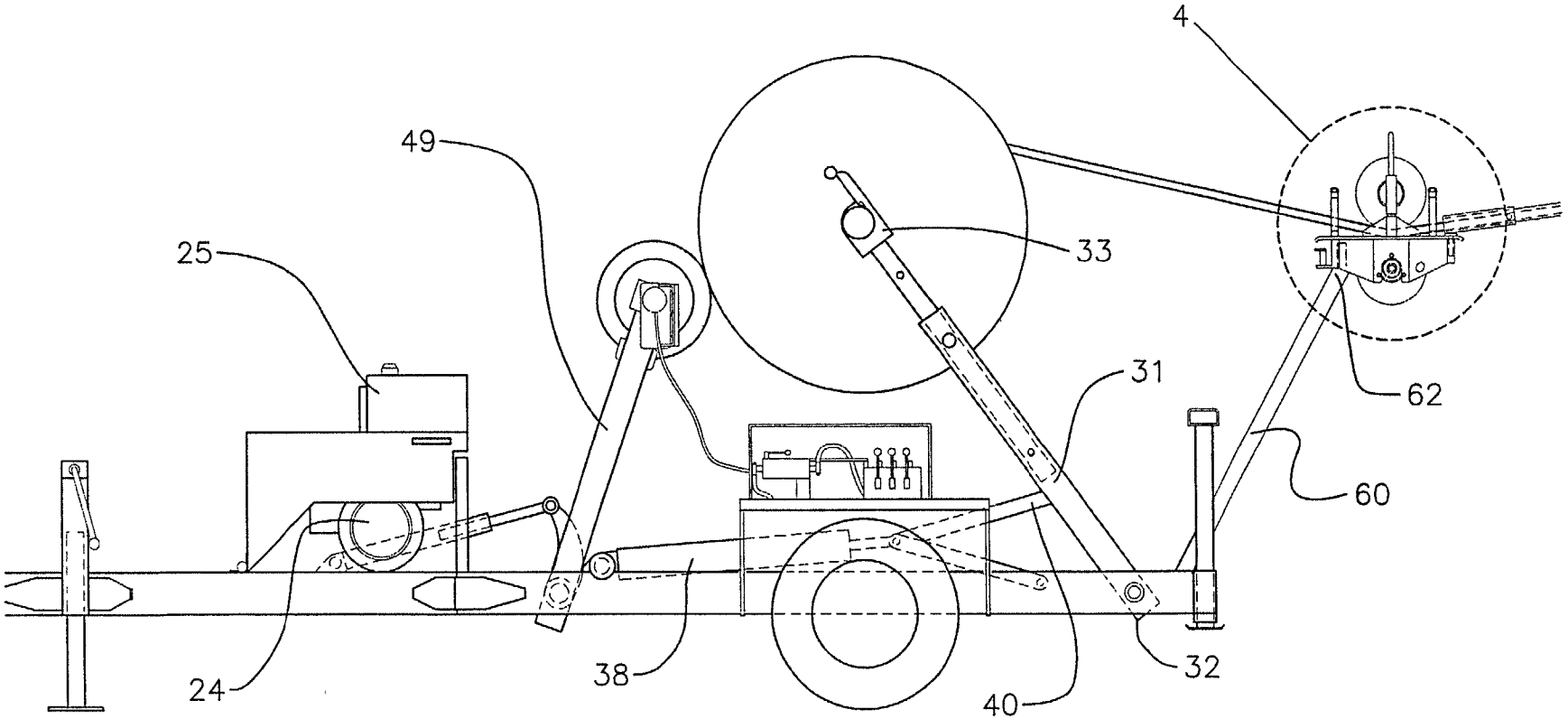
FIG. 3 is a schematic side view of the present invention.
Figure 4:
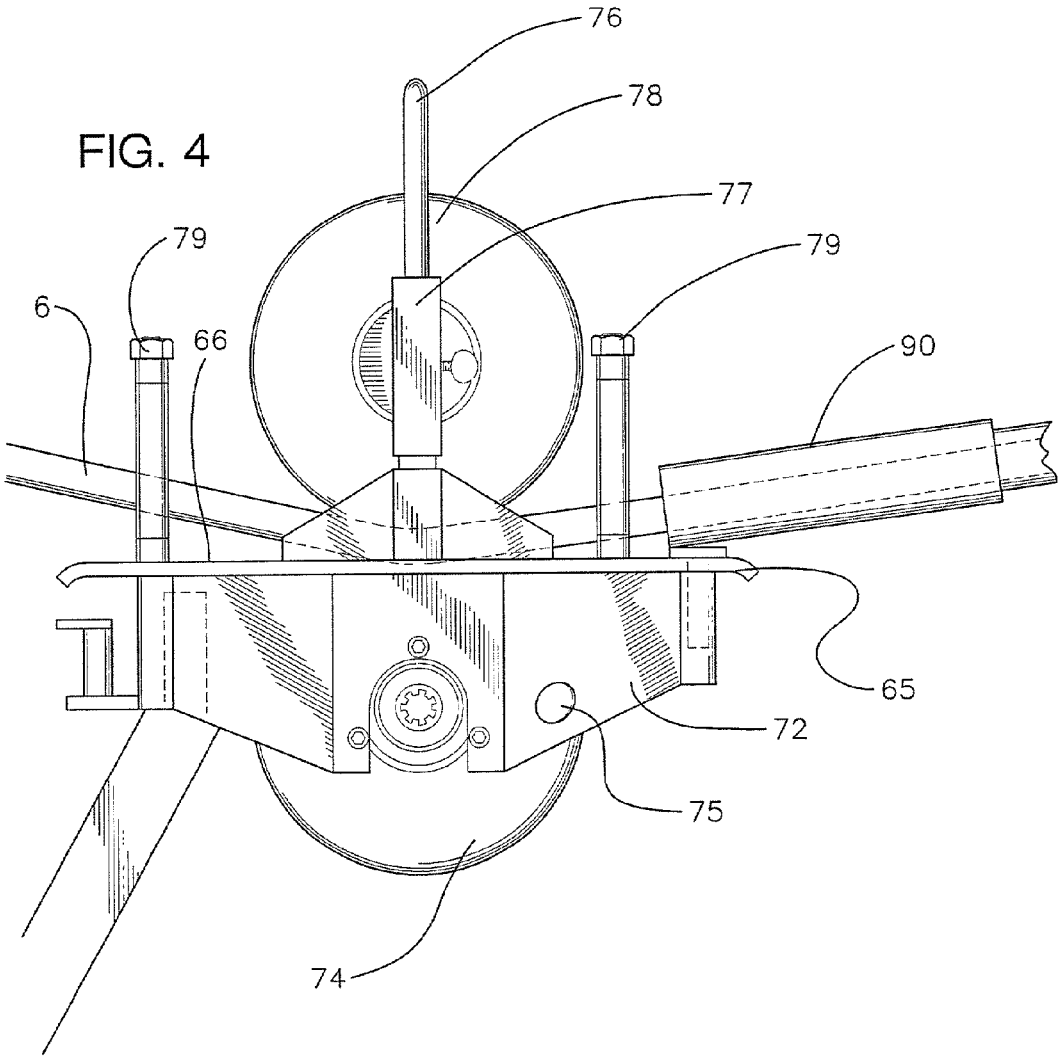
FIG. 4 is a schematic side view of the tire portions of the cable guiding means of the present invention.
Figure 5:
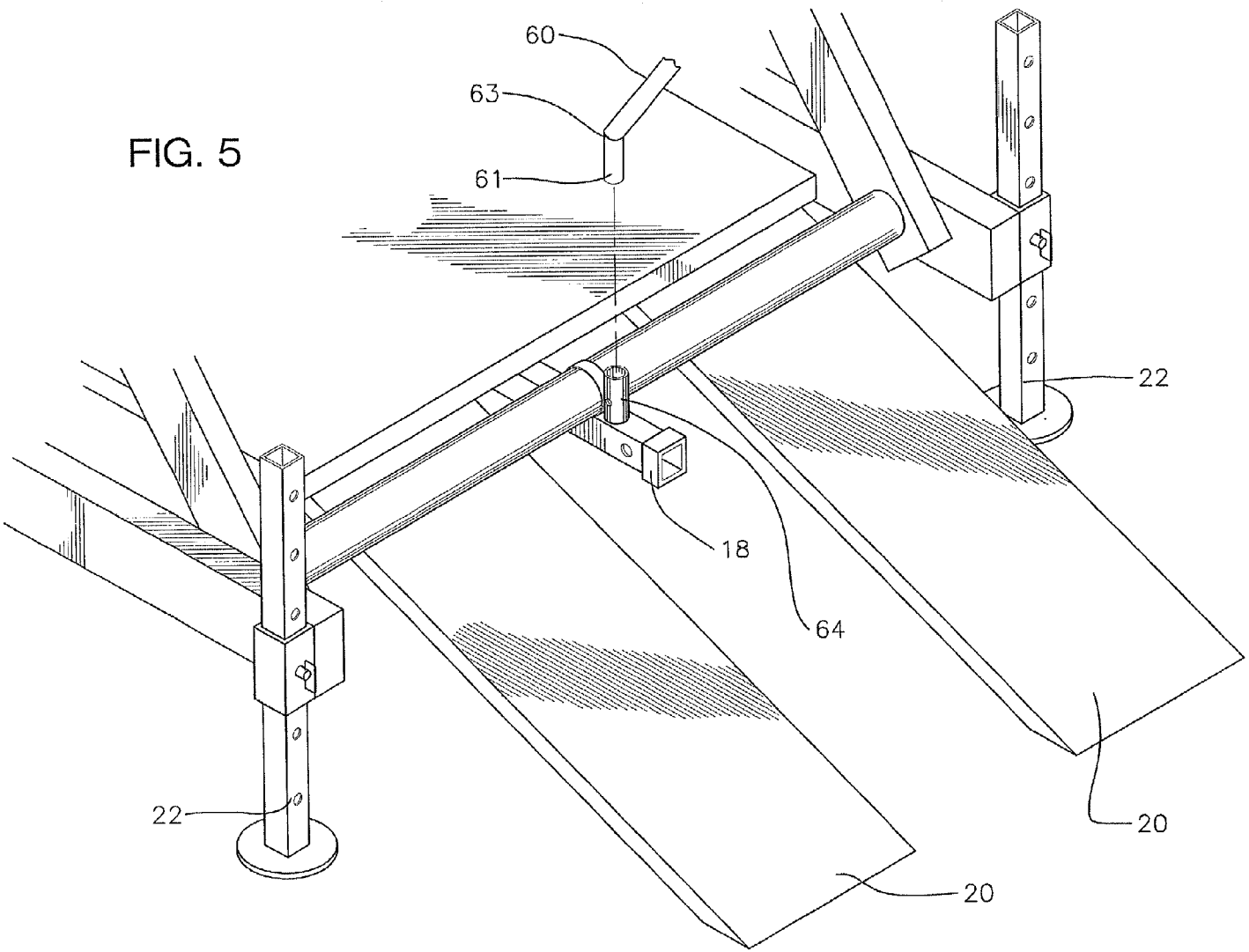
FIG. 5 is a schematic perspective view of the back end of the trailer of the present invention.
Figure 6:
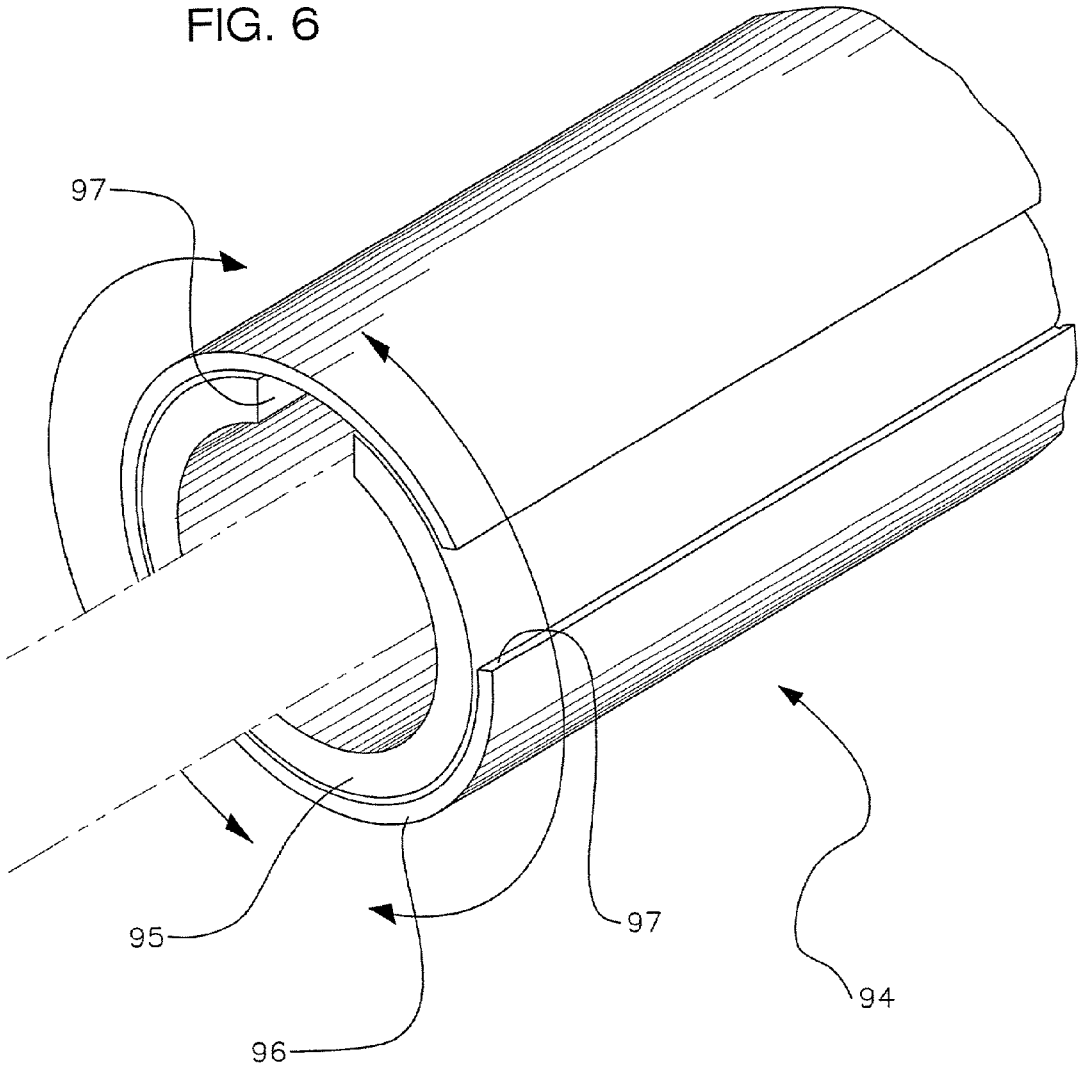
FIG. 6 is a schematic perspective view of the extension member of the cable guiding means of the present invention.
Figure 7:
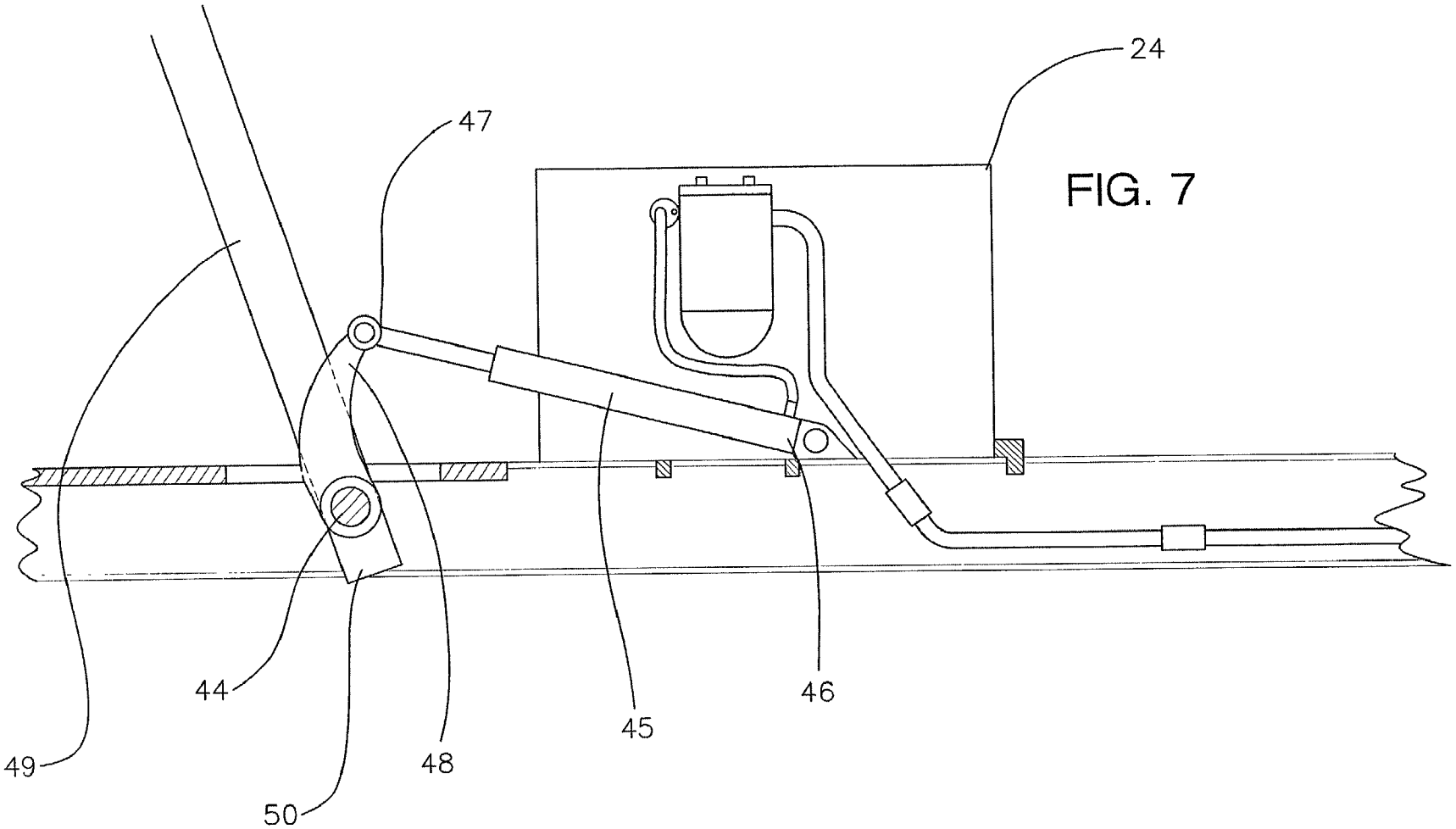
FIG. 7 is a schematic side view of the power supply of the present invention.
Figure 8:
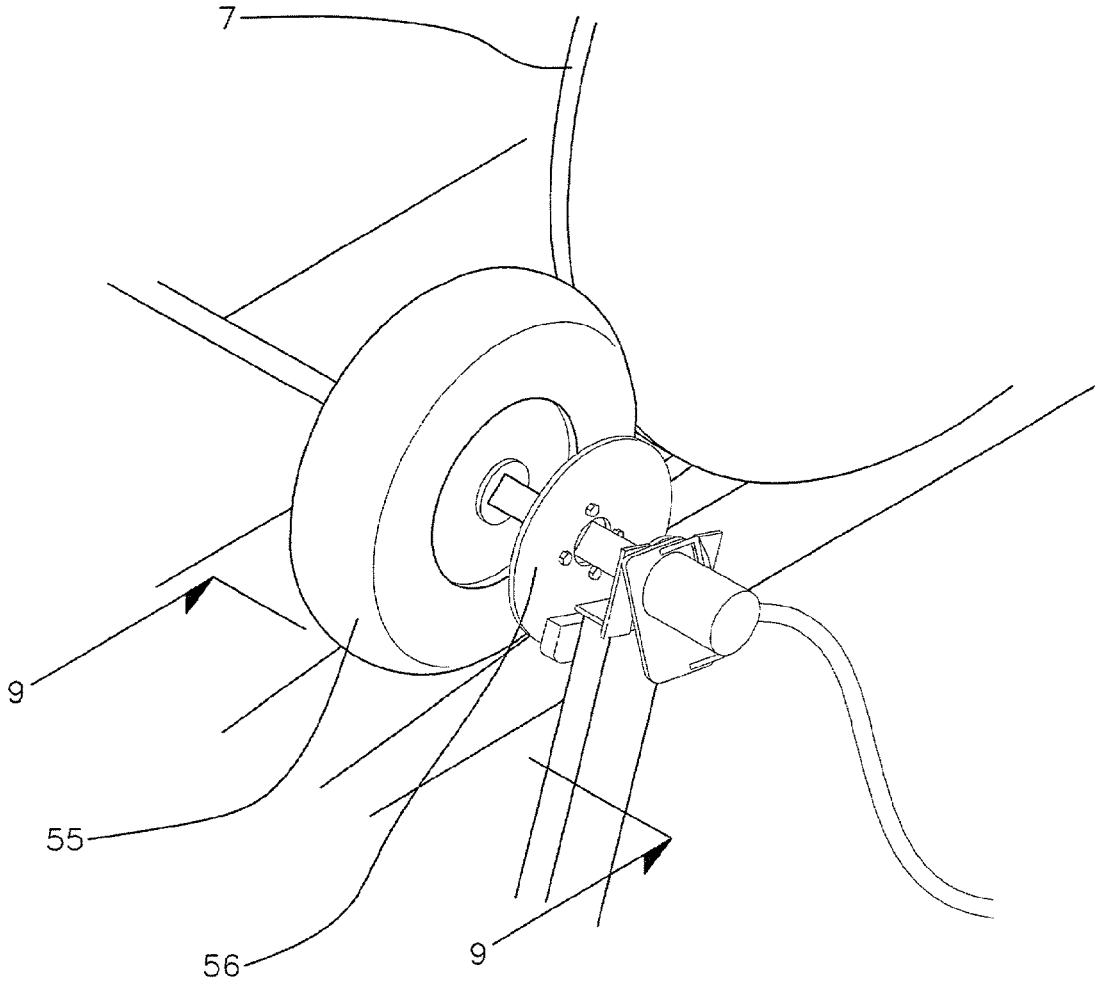
FIG. 8 is a schematic perspective view of the breaking means of the present invention.
Figure 9:
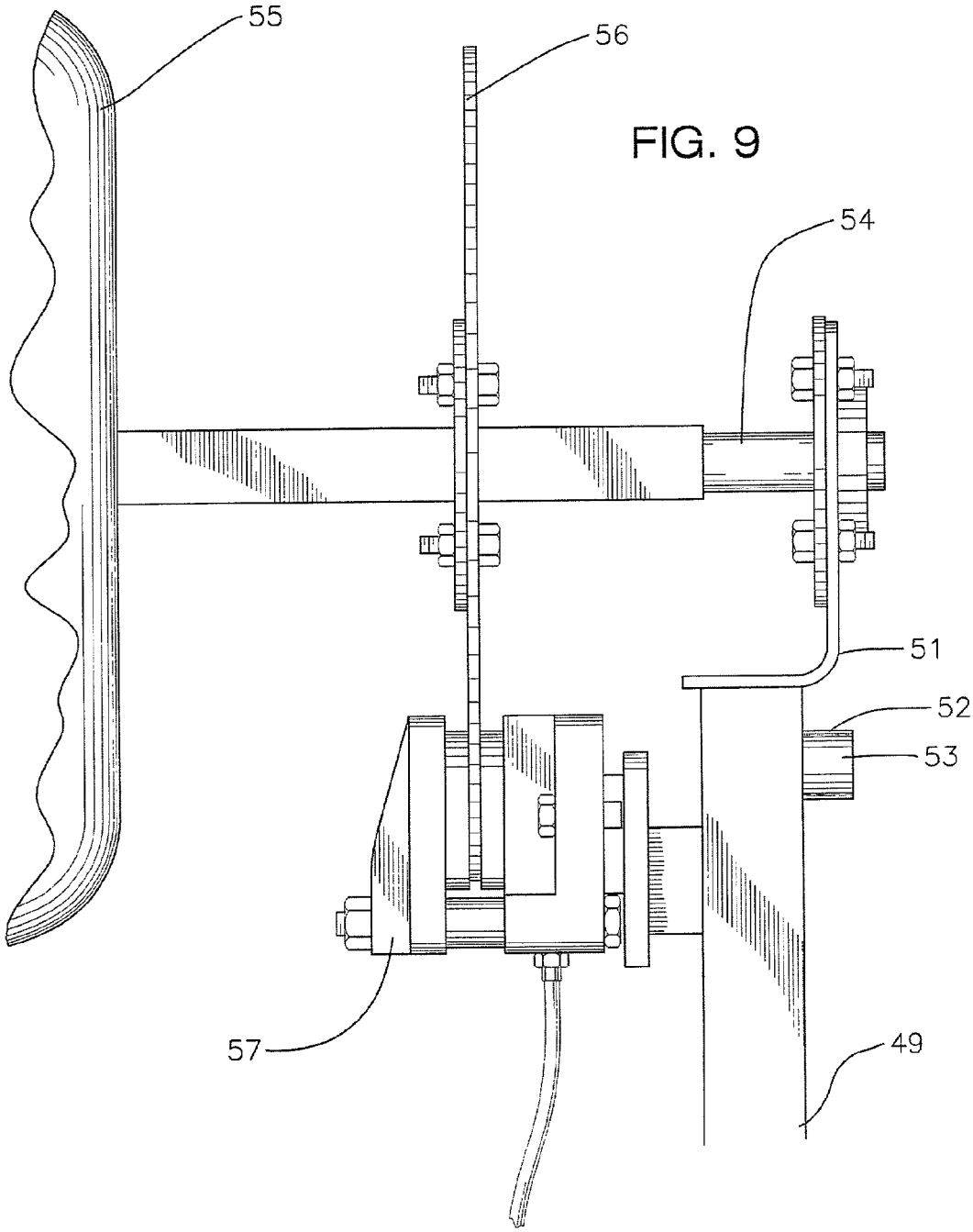
FIG. 9 is a schematic front view of the breaking means of the present invention.
Figure 10:
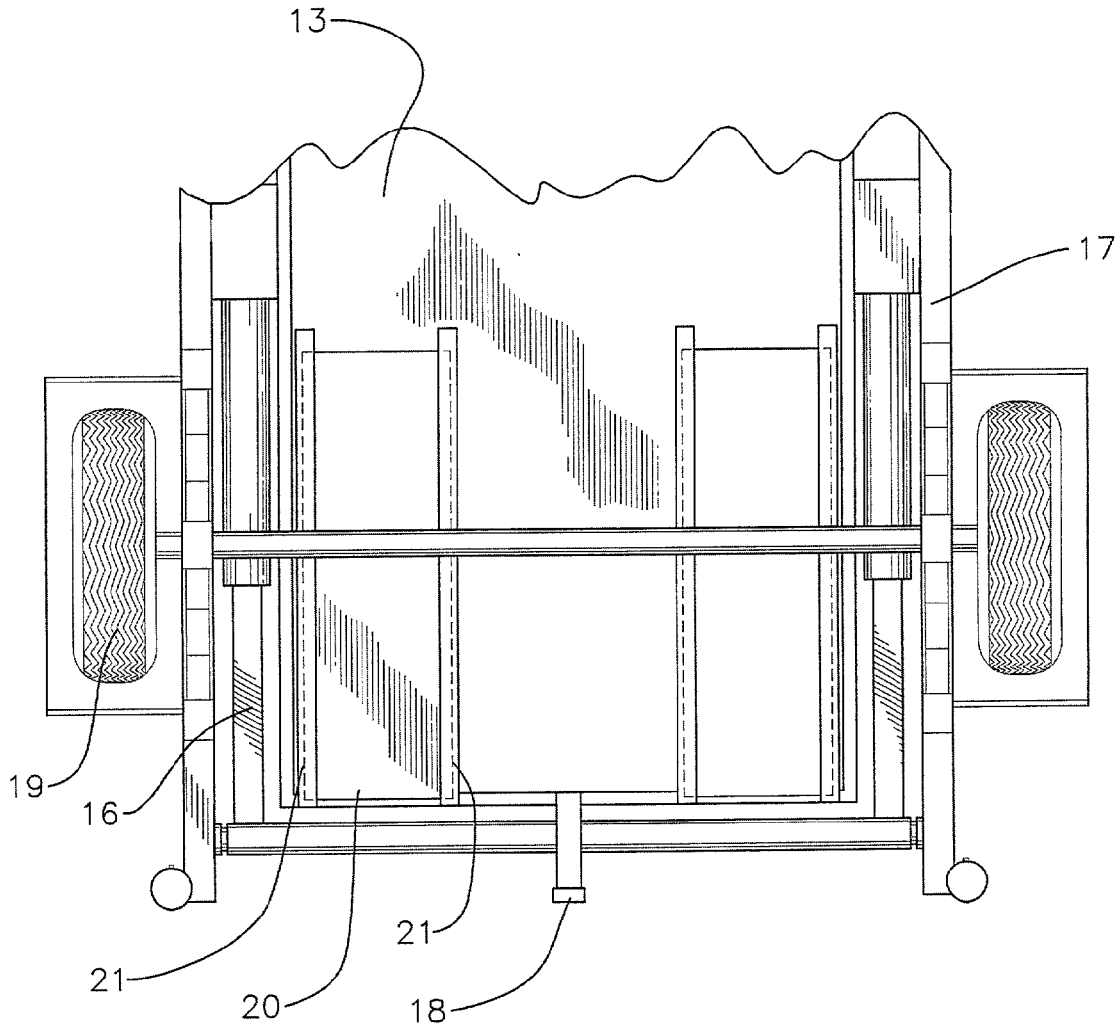
FIG. 10 is a schematic bottom view of the trailer of the present invention.
Figure 11:
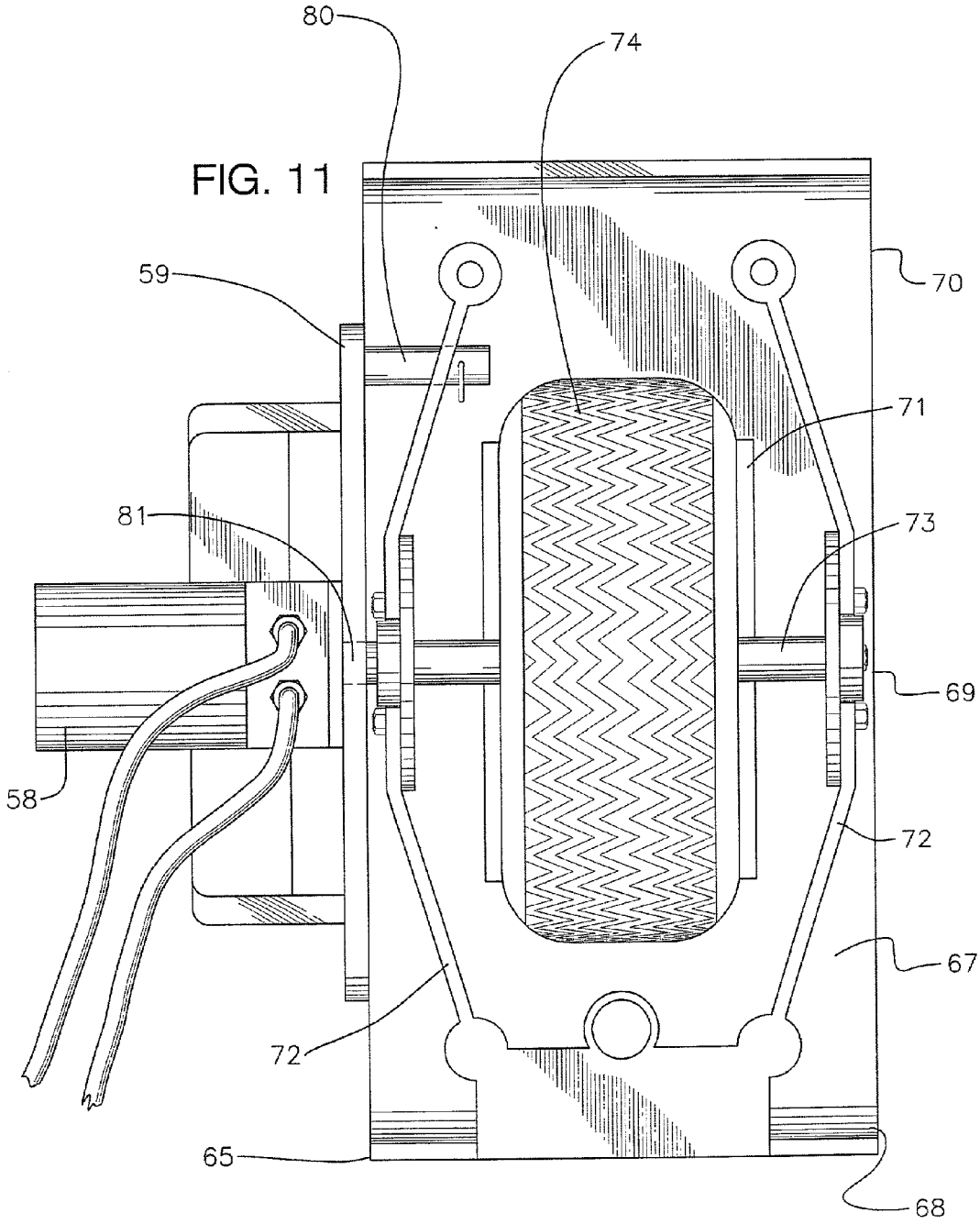
FIG. 11 is a schematic bottom view of the panel of the cable guiding means of the present invention.

In use, the apparatus 10 is used for laying cable 6, such as fiber optic cable, which cannot be easily spliced for re-routing under roadways and such. A user first uses the support arms 31 to pick up the spool 5. This is done by moving the support arms 31 away from the trailer 11 and placing the second ends 33 of the support arms under the elongate pole 28 which is inserted through the spool. The first 38 and second 41 actuators then lift the spool onto the trailer. The spool may be transported in this way as well. When a user of the apparatus 10 comes across a roadway, it is necessary to unwind the entire spool of cable to get to the end to run it under the roadway. The user does this by placing the elongate member 60 in the mounting 64 on the back end of the trailer 11. The cable 6 is positioned into the guide members 79, between the tire portions 74, 78 and placed in the slits in the cylinder 90 and extension member 94. The inner sleeve 95 is rotated to close the slit in the extension member 94. The motor 58 is positioned on the wall 72 so that it may engage the arm 73 to turn the first wheel portion 74. The motor 58 is turned on and the tire portions begin to extract the cable 6 by pulling it off of the spool 5. The elongate member 60 is moved back and forth to allow the cable to fall upon the ground in the shape of a FIG. 8 so that it does not tangle. The wheels 55 are placed against the outer discs as shown in FIG. 3 and the breaking means 57 is used to slow the spool if it should turn too fast. When all of the cable 6 is off of the spool, it is returned to the spool by running the cable through the cable guiding means and back on the spool. The motor is attached to the first axle 54 and the spool is rotated using the wheels 55. The operator moves the cable guide member back and forth to evenly distribute the cable onto the spool.

The breaking means 57 also serves the dual purpose of creating tension in the cable while the cable is being laid. This useful when the cable is being position on telephone poles and the like where the cable must have tension to keep it off of the ground.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cable handling trailer system comprising:

a trailer having a front end, a back end, and a pair of lateral sides;

a lifting assembly for lifting a spool of cable onto and off of the trailer and supporting the spool on the trailer between the front and back ends of the trailer, the lifting assembly being pivotally mounted on the trailer; and cable guiding means for guiding movement of cable onto and off of the spool in a substantially horizontal orientation between the spool and the cable guiding means when the spool is supported on the lifting means, the cable guiding means being mounted on the trailer rearwardly of the lifting assembly for supporting a length of the cable in a rearward direction from the spool supported on the lifting assembly.

2. The system of claim 1 wherein the cable guiding means comprises:

a guide structure for engaging a portion of cable moving onto and off of the spool; and a boom structure mounted on the trailer for supporting the guide structure, the boom structure being pivotally mounted on the trailer such that the guide structure is movable along a path extending generally transverse to an axis of the trailer extending between the front and back ends of the trailer.

3. The system of claim 2 wherein the boom structure has a proximal end pivotally mounted on the trailer and a distal end extending away from the back end of the trailer in a cantilevered manner.

4. The system of claim 2 wherein the guide structure comprises first and second rotatable members having circumferential surfaces positionable adjacent to each other for moving a portion of the cable positioned between the circumferential surfaces of the first and second rotatable members.

5. The system of claim 4 wherein the first and second rotatable members are movable toward and away from each other such that the circumferential surface of the second rotatable member is abuttable against the circumferential surface of the first rotatable member.

6. The system of claim 1 wherein the lifting assembly comprises:

an elongate pole for extending through a hole in a spool, the elongate pole having a pair of opposite ends; and a pair of support arms for supporting the elongate pole, the elongate pole being rotatably and releasably mounted on each of the support arms, each of the support arms being pivotally mounted on the trailer such that the support arms are pivotable between a transport position and a retrieve position, the transport position being characterized by the elongate pole being positioned forward of the back end of the trailer, the retrieve position being characterized by the elongate pole being positioned behind the back end of the trailer.

7. The system of claim 1 additionally comprising means located on the front end of the trailer for hitching the trailer to a vehicle so that the trailer is towable by the vehicle.

8. The system of claim 1 wherein the cable guiding means is pivotally mounted on the trailer to pivot about a substantially vertical axis and permit lateral movement of the length of cable in a substantially horizontal plane.

9. A cable handling trailer system comprising:

a trailer having a front end, a back end, and a pair of lateral sides;

a lifting assembly for lifting items into and off of the trailer, the lifting assembly being pivotally mounted on the trailer; and control means for controlling the supply of power from a power source to the lifting assembly, the control means including a housing for mounting at least one control thereon, the housing is movably mounted on the trailer to permit swinging movement of the housing between a storage position at a first location and an operational position at a second location.

10. The system of claim 9 wherein the second location of the operational position is characterized by a portion of the housing extending rearwardly of the back end of the trailer and the first location of the storage position is characterized by the housing being positioned above the trailer.

11. The system of claim 9 wherein the control means further comprises a pivot mount pivotally connecting the housing to the trailer and having a pivot axis about which the housing swings between the first location and the second location.

12. The system of claim 11 wherein the control means further comprises a pivot arm extending between the pivot mount and the housing for spacing the housing from the pivot axis of the pivot mount.

13. The system of claim 9 wherein the first location of the storage position is further characterized by the housing being positioned over the trailer, and the second location of the operational position is further characterized by the housing being positioned at a location that is not above the trailer.

14. A cable handling trailer system comprising:

a trailer having a front end, a back end, and a pair of lateral sides;

a lifting assembly for lifting items into and off of the trailer; and a level winding assembly for guiding cable winding onto a spool when the spool is mounted on the lifting assembly, the level winding assembly including a swing structure located on the trailer rearwardly of the lifting assembly, the swing structure being pivotally mounted on the trailer for pivot movement about a substantially horizontal axis to produce lateral movement of the swing structure in a substantially vertical plane transverse to the trailer.

15. The system of claim 14 wherein the level winding assembly comprises:

a base structure for removably mounting on the trailer, the swing structure being pivotally mounted on the base structure; and a swing actuator structure for pivoting the swing structure with respect to the base structure.

16. The system of claim 15 wherein the swing structure comprises:

an arm having a lower end pivotally mounted on the base structure and an upper end;

a head portion mounted on an upper end of the arm, the head portion having a plurality of rollers formed into a U-shaped configuration with an open top.

17. A cable handling trailer system comprising:

a trailer having a front end, a back end, and a pair of lateral sides;

a lifting assembly for lifting items into and off of the trailer, the lifting assembly being pivotally mounted on the trailer; and a driving mechanism for controlling rotation of the spool, the driving mechanism comprising:

spool engaging means for engaging at least one of the outer discs of the spool to rotate the spool; and supporting means for supporting the spool engaging means on the trailer.

18. The system of claim 17 wherein the spool engaging means comprises:

a pair of laterally spaced wheels, each of the wheels having a circumferential surface for engaging a circumferential edge of one of the outer discs of the spool;

a rotator axle rotatably mounted and having the laterally spaced wheels mounted thereon such that the laterally spaced wheels rotate with the rotator axle;

a braking means for braking rotation of the rotator axle and the laterally spaced wheels; and a motor coupled to the axle for rotating the rotator axle in two directions of rotation.

19. The system of claim 17 wherein the supporting means comprising:

a pivotal axle mounted on the trailer in a manner permitting pivot rotation of the pivotal axle about a longitudinal axis of the pivotal axle;

an upright member mounted on the pivotal axle and extending outwardly from the pivotal axle in a direction substantially perpendicular to the longitudinal axis of the pivotal axis, an actuating member having a first end and a second end, the first end of the actuating member being coupled to the trailer and the second end of the actuating member being coupled to the upright member; and a pair of bars, each of the bars being elongate and having a first end and a second end, the first ends of the bars being coupled to the pivotal axle and the second ends of the bars being coupled to the rotator axle.

* * * * *